US009901227B2

(12) United States Patent
Conrad

(10) Patent No.: US 9,901,227 B2
(45) Date of Patent: Feb. 27, 2018

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 282 days.

(21) Appl. No.: 14/504,776

(22) Filed: Oct. 2, 2014

(65) Prior Publication Data

US 2015/0026916 A1 Jan. 29, 2015

Related U.S. Application Data

(63) Continuation of application No. 12/846,144, filed on Jul. 29, 2010, now Pat. No. 8,869,348.

(30) Foreign Application Priority Data

Jul. 30, 2009 (CA) ..... 2674758

(51) Int. Cl.

| | |
|---|---|
| ***A47L 5/22*** | (2006.01) |
| ***A47L 5/28*** | (2006.01) |
| ***A47L 9/24*** | (2006.01) |
| ***A47L 9/00*** | (2006.01) |

(52) U.S. Cl.

CPC ..... *A47L 5/225* (2013.01); *A47L 5/28* (2013.01); *A47L 9/0054* (2013.01); *A47L 9/242* (2013.01)

(58) Field of Classification Search

CPC ... A47L 5/28; A47L 5/225; A47L 5/32; A47L 9/325; A47L 9/009; A47L 9/0054; A47L 9/242

USPC ..... 15/331, 332, 335, 401, 410, 411; 403/95

See application file for complete search history.

(56) References Cited

U.S. PATENT DOCUMENTS

| | | | |
|---|---|---|---|
| 2,300,204 | A | 10/1942 | Carlson |
| 2,464,587 | A | 3/1949 | Knight |
| 2,851,313 | A | 9/1958 | Bradley, Jr. |
| 4,462,137 | A | 7/1984 | Berfield et al. |
| 4,947,512 | A | 8/1990 | Lackner et al. |
| 5,279,018 | A | 1/1994 | Glenn, III |
| 5,323,510 | A | 6/1994 | Redding et al. |
| 5,351,361 | A | 10/1994 | Buchtel |
| 5,524,321 | A | 6/1996 | Weaver et al. |

(Continued)

FOREIGN PATENT DOCUMENTS

| | | |
|---|---|---|
| CA | 2675713 | 6/2008 |
| CA | 2675713 A1 | 7/2009 |

*Primary Examiner* — Marc Carlson

(74) *Attorney, Agent, or Firm* — Philip C. Mendes da Costa; Bereskin & Parr LLP/S.E.N.C.R.L., s.r.l.

(57) ABSTRACT

An upright surface cleaning apparatus comprises an upper section moveably mounted to the surface cleaning head between a floor cleaning position, in which the upright surface cleaning apparatus is useable for cleaning a floor, and a storage position, the upper section also being rotatably coupled to the surface cleaning head whereby rotation of the upper section relative to the surface cleaning head is enabled. The upright surface cleaning apparatus further comprises an anti-rotation locking mechanism inhibiting rotation of the upper section when the upper section is in the storage position and a cleaning unit that is removably mounted to the upper section and is removable while the upper section is in the storage position.

19 Claims, 15 Drawing Sheets

(56) References Cited

U.S. PATENT DOCUMENTS 5,584,095 A 12/1996 Redding et al.
5,715,566 A * 2/1998 Weaver ..... A47L 5/225 15/3
6,055,703 A 5/2000 Redding et al.
6,058,559 A * 5/2000 Yoshimi ..... A47L 5/225 15/323
6,115,880 A 9/2000 Wulff et al.
7,013,521 B2 3/2006 Grey
7,159,273 B2 1/2007 Fawcett
7,188,388 B2 3/2007 Best et al.
7,377,007 B2 5/2008 Best
7,377,008 B2 5/2008 Park et al.
7,383,609 B2 6/2008 Ji
7,503,098 B2 3/2009 Stein
7,607,196 B2 10/2009 Li
7,805,804 B2 * 10/2010 Loebig ..... A47L 5/28 15/351
7,870,638 B2 1/2011 Jansen
7,877,836 B2 2/2011 O'Neal
8,060,981 B2 11/2011 Bassett et al.
8,127,398 B2 3/2012 Conrad
8,166,607 B2 4/2012 Conrad
8,201,302 B2 6/2012 Poetting
8,375,508 B2 2/2013 Conrad
8,479,358 B2 7/2013 Conrad
8,661,613 B2 3/2014 Marsh et al.
8,667,643 B2 3/2014 Simonelli et al.
2001/0023517 A1 9/2001 Onishi et al.
2002/0017005 A1 2/2002 Kim et al.
2002/0108208 A1 8/2002 Hamada et al.
2003/0051307 A1 3/2003 Hashizume et al.
2003/0145420 A1 8/2003 Park et al.
2004/0216263 A1 * 11/2004 Best ..... A47L 5/225 15/331
2004/0261211 A1 12/2004 Overvaag et al.
2005/0235454 A1 10/2005 Courtney
2006/0218741 A1 * 10/2006 Kang ..... A47L 5/225 15/328
2007/0017063 A1 1/2007 Park et al.
2007/0113369 A1 5/2007 Cochran et al.
2007/0209147 A1 * 9/2007 Krebs ..... A47L 5/30 15/347
2007/0209152 A1 9/2007 Pullins et al.
2007/0226937 A1 10/2007 Courtney
2007/0226946 A1 10/2007 Best
2007/0245514 A1 10/2007 Luebbering et al.
2008/0148510 A1 * 6/2008 Yoo ..... A47L 5/28 15/323
2008/0178420 A1 * 7/2008 Conrad ..... A47L 5/225 15/410
2008/0209666 A1 9/2008 Conrad
2008/0209671 A1 * 9/2008 Conrad ..... A47L 9/04 15/389
2009/0007368 A1 * 1/2009 Oh ..... A47L 5/225 15/339
2009/0056059 A1 3/2009 Mersmann et al.
2009/0056065 A1 3/2009 Myers
2009/0094779 A1 4/2009 Jansen
2009/0144929 A1 6/2009 Yoo
2010/0139030 A1 * 6/2010 Yoo ..... A47L 5/225 15/328
2010/0229338 A1 * 9/2010 Conrad ..... A47L 5/24 15/415.1
2010/0251506 A1 10/2010 Conrad
2011/0023256 A1 * 2/2011 Conrad ..... A47L 5/225 15/300.1
2011/0023262 A1 2/2011 Conrad
2011/0107553 A1 5/2011 Myers
2011/0219573 A1 9/2011 Conrad
2011/0219579 A1 9/2011 Conrad
2011/0219580 A1 9/2011 Conrad
2011/0219581 A1 9/2011 Vines et al.
2012/0060322 A1 3/2012 Simonelli et al.
2012/0079679 A1 4/2012 Seo
2012/0090105 A1 4/2012 Henderson
2012/0090131 A1 4/2012 Woerwag

* cited by examiner

SURFACE CLEANING APPARATUS

CROSS-REFERENCE TO RELATED APPLICATIONS

This application is a continuation of U.S. application Ser. No. 12/846,144 entitled SURFACE CLEANING APPARATUS and filed Jul. 29, 2010, now allowed, the entirety of which is hereby incorporated by reference.

FIELD

The specification relates to a surface cleaning apparatus and preferably an upright surface cleaning apparatus having an anti-rotation locking mechanism. The surface cleaning apparatus may also comprise an alignment mechanism.

INTRODUCTION

The following is not an admission that anything discussed below is prior art or part of the common general knowledge of persons skilled in the art.

Various types of surface cleaning apparatus are known. Typical upright vacuum cleaners include an upper section, including an air treatment member such as one or more cyclones and/or filters, drivingly mounted to a surface cleaning head. An up flow conduit is typically provided between the surface cleaning head and the upper section. In some such vacuum cleaners, a spine, casing or backbone extends between the surface cleaning head and the upper section for supporting the upper section. The air treatment member or members and/or the suction motor may be provided on the upper section.

Surface cleaning apparatus having a rotational connection between the upper section and the surface cleaning head that can be rotatably secured in position are known. U.S. Pat. No. 7,503,098 (Stein) discloses a connection arrangement between a vacuum cleaner and a suction tool that includes a pivot element pivotably connected to the suction tool and a rotation element rotatably coupled to the pivot element. A suction wand, hose, handle or other part of the vacuum cleaner is removably connected to a connection end of the rotation element. Coupling ends of the pivot and rotation elements are inserted one in the other, and respectively have circumferential grooves that form a circumferential channel therebetween. Plural partial ring segment elements are received in the circumferential channel to form a connection ring that rotatably secures the pivot and rotation elements. The ring segment elements are inserted into or removed from the channel through a selectively coverable opening in the rotation element or the pivot element. A catch cooperates with a detent to hold a vertically pivoted, rotationally centered rest position of the components.

SUMMARY

The following introduction is provided to introduce the reader to the more detailed discussion to follow. The introduction is not intended to limit or define the claims.

According to one broad aspect, a surface cleaning apparatus such as an upright vacuum cleaner may comprise an upper section comprising a support structure. The support structure is moveable between a storage position and an angled or declined or floor cleaning position. In the storage position the upper section preferably is in a generally upright or vertical orientation and the vacuum cleaner may be free-standing or self-supporting so that it can stand in a closet or other storage location without leaning, tipping or falling over. In addition, the upper section is rotatable relative to the surface cleaning head about a longitudinally extending axis (i.e., it may rotate about an axis extending through the upper section). The vacuum cleaner comprises an anti-rotation locking mechanism that retains the support structure in a given orientation and inhibits changes in orientation once the support structure is in the storage position. In accordance with this aspect, the anti-rotation locking mechanism is automatically engaged when the support structure is moved in the storage position by a user, and is automatically disengaged when a user moves the support structure into the floor cleaning position, allowing the user to freely change the orientation of the support structure and maneuver the vacuum cleaner during use.

The stability of a vacuum cleaner in the storage position may depend on the orientation of the support structure relative to the surface cleaning head. A vacuum cleaner may be stable when the support structure is in a particular orientation (for example when it is centered relative to the surface cleaning head so that the center of gravity of the upper section lies generally above the centerline extending from the front to the back of the surface cleaning head) and may be unstable in another orientation (for example when the support structure is rotated to the left or right such that the center of gravity of the upper section no longer overhangs the centerline. Absent a locking or securing mechanism, a support structure that is initially placed in a stable orientation may move or rotate into an unstable orientation when released by the user. Accordingly an advantage of this aspect is that the upper section will be automatically secured in a stable storage position when the upper section is moved into the storage position. Further, a user does not have to actuate a foot pedal or other lock release member to move the upper section to a floor cleaning position. A user may forget that there is a lock release that has to be actuated and may force the upper section into a floor cleaning position, thereby breaking the surface cleaning apparatus.

According to another broad aspect, a surface cleaning apparatus such as an upright vacuum cleaner may comprise an upper section, comprising a support structure that is moveable between a storage position and a floor cleaning position. In accordance with this aspect, the vacuum cleaner comprises an anti-rotation locking mechanism that is automatically engaged when the support structure is moved in the storage position by a user and an alignment mechanism. The alignment mechanism comprises a guiding or directing apparatus that assists to align the support structure relative to the surface cleaning head when the upper section is moved to the storage position. The alignment of the support structure may be done using a separate apparatus, or may use components that are common with the anti-rotation locking mechanism. It will be appreciated that the first aspect may optionally utilize the alignment mechanism.

An advantage of this aspect is that the anti-rotation locking mechanism may be damaged if the user tries to move the upper section to the storage position when the components of the anti-rotation locking mechanism are out of alignment. Further, if the anti-rotation locking mechanism is capable of locking the upper section in more than one orientation, then the upper section could be placed in the storage position with the upper section secured in an unstable orientation. The alignment mechanism would assist to ensure that the upper section is placed in the storage position in a stable orientation.

In any aspect, the support structure may comprise a bendable or pivotal construction that is drivingly connected to a surface cleaning head and/or a cleaning unit that is optionally removably mounted to the support structure. In some embodiments, the cleaning unit may be removed from the support structure while remaining in airflow communication with the surface cleaning head. In other embodiments, the cleaning unit may be removed from the support structure and from airflow communication with the surface cleaning head and be capable as being used as a separate cleaning unit.

In accordance with one aspect, there is provided an upright surface cleaning apparatus having a front, a rear and opposed lateral sides may comprise a surface cleaning head having a dirt inlet, an upper section moveably mounted to the surface cleaning head between an floor cleaning position and a storage position, an air flow path extending from the dirt inlet to a clean air outlet with a suction motor and a treatment member provided in the air flow path and, an anti-rotation locking mechanism automatically operably engaged when the upper section is moved into the storage position and automatically operably disengaged when the upper section is moved into the floor cleaning position.

In any embodiment, the upper section may comprise a rotational coupling member having a longitudinally extending member and the upper section is rotatably mounted about the longitudinal axis and the longitudinal axis extends through a portion of the air flow path.

In any embodiment the rotational coupling member may comprise a portion of the air flow path.

In any embodiment the rotational coupling member may comprise an up flow duct.

In any embodiment the suction motor and the treatment member may be provided in a cleaning unit and the cleaning unit may be removably mounted to the upper section.

In any embodiment the upper section may have an absence of a housing defining a recess for receiving the cleaning unit.

In any embodiment the cleaning unit may be useable in a first configuration wherein the cleaning unit is mounted on the upright surface cleaning apparatus and at least one additional configuration wherein the cleaning unit is removed from the upright surface cleaning apparatus and attached in air flow communication with the surface cleaning head or wherein the cleaning unit is removed from the upright surface cleaning apparatus and removed from air flow communication with the surface cleaning head and useable as a portable surface cleaning apparatus.

In any embodiment the upper section may be rotationally mounted to the surface cleaning head and the storage position may include a particular orientation of the upper section and the apparatus may further comprise an alignment mechanism comprising a first cooperating alignment member associated with the surface cleaning head and a second cooperating alignment member associated with the upper section, the first and second cooperating alignment members guide the upper section to the particular orientation when the upper section is moved into the storage position.

In any embodiment the anti-rotation locking mechanism and the alignment mechanism may utilize common components.

In any embodiment the anti-rotation locking mechanism may comprise a pair of spaced apart engagement members and complimentary locking members.

In any embodiment the spaced apart engagement members maybe provided on the lateral sides.

In any embodiment the engagement members may be moveably mounted and biased to a disengaged position, each engagement member having an engaging end and the engaging ends are secured together.

In any embodiment the engaging ends may be secured together by a connector that extends around a portion of the fluid flow path.

In any embodiment the connector may engage the complimentary locking members.

In any embodiment the anti-rotation locking mechanism may further comprise a cam member provided on the surface cleaning head and drivingly associated with the engagement member and the complimentary locking members may comprise receiving members provided on the upper section and the engagement members may be moveable longitudinally to cooperate with the receiving members.

In any embodiment the alignment mechanism may comprise a portion of at least one of the receiving members.

In any embodiment the complimentary locking members may comprise a cam member.

According to another broad aspect, an upright surface cleaning may have apparatus a front, a rear and opposed lateral sides and may include a surface cleaning head having a dirt inlet. The surface cleaning apparatus may include an upper section moveably mounted to the surface cleaning head between a floor cleaning position, in which the upright surface cleaning apparatus is useable for cleaning a floor, and a storage position. The upper section may be rotatably coupled to the surface cleaning head whereby rotation of the upper section relative to the surface cleaning head is enabled. A cleaning unit may be removably mounted to the upper section. The cleaning unit may include an air treatment member, a suction motor and a clean air outlet. An air flow path may extend from the dirt inlet to the clean air outlet and may include the air treatment member and the suction motor. An anti-rotation locking mechanism may inhibit rotation of the upper section when the upper section is in the storage position. The cleaning unit may be removable while the upper section is in the storage position.

In any embodiment, the surface cleaning apparatus may have at least two operating modes including:

- a first operating mode in which the cleaning unit is mounted to the upper section and is in airflow communication with the dirty air inlet and the flexible hose comprises a portion of the airflow path between the cleaning unit and the dirty air inlet; and
- a second operating mode in which the cleaning unit is removed from the upper section and is in airflow communication with the dirty air inlet and the flexible hose comprises a portion of the airflow path between the cleaning unit and the dirty air inlet.

In any embodiment, when the surface cleaning apparatus is in the first operating mode the cleaning unit may be supported by the upper section.

In any embodiment, the upper section may be movable between the storage position and the floor cleaning position when the surface cleaning apparatus is in the first operating mode or the second operating mode.

In any embodiment, the surface cleaning apparatus may be changeable between the first operating mode and the second operating mode without interrupting the airflow communication between the dirty air inlet and the cleaning unit.

In any embodiment, the surface cleaning apparatus may be operable in a third operating mode in which the cleaning unit is detached from the upper section and is not in air flow communication with the surface cleaning head and is operable as a hand vacuum cleaner.

In any embodiment, the upper section may include a rigid airflow conduit, and wherein the cleaning unit may be supported on the rigid airflow conduit when mounted to the upper section.

In any embodiment, the cleaning unit may be vertically removable from the upper section when the upper section is in the storage position.

In any embodiment, the cleaning unit may be removable in the absence of adjusting a configuration of the upper section.

In any embodiment, the anti-rotation locking mechanism may include a first abutment member and a second abutment member spaced apart from the first abutment member. The first and second abutment members may each extend laterally outward from one of the surface cleaning head and the upper section. The other of the surface cleaning head and the upper section may include a stop member having a first stop face and a second stop face spaced apart from the first stop face, when the upper section is in the storage position the first abutment member abuts the first stop face and the second abutment member abuts the second stop face, and when the upper section is in the floor cleaning position the first abutment member is spaced apart from the first stop face and the second abutment member is spaced apart from the second stop face.

In any embodiment, the first and second abutment members and the stop member may include an alignment mechanism whereby contact between at least one of the abutment members and the stop member guides the upper section to a storage rotational orientation when the upper section is moved from the floor cleaning position into the storage position.

In any embodiment, the upper section may be rotatably coupled to the surface cleaning head by a rotational coupling member and the rotational coupling member comprises a portion of the air flow path.

In any embodiment, the first and second abutment members may be provided on opposed sides of the upper section and the stop member is provided on the surface cleaning head.

In any embodiment, the upper section may include a rotational coupling member having a longitudinally extending member that comprises a portion of the airflow path and extends along a longitudinal axis, whereby the longitudinal axis extends through a portion of the airflow path.

In any embodiment, the air flow path may include a flexible hose having a downstream end coupled to the cleaning unit.

In any embodiment, the anti-rotation locking mechanism may be operable in both the first and second operating modes.

In any embodiment, the air treatment member may include at least a first cyclone chamber having an air inlet, an air outlet and a dirt outlet, and at least a first dirt collection chamber in communication with the dirt outlet.

In any embodiment, the first dirt collection chamber may be external the first cyclone chamber.

In any embodiment, the first cyclone chamber may include a cyclone axis about which air within the first cyclone circulates and the first dirt collection chamber is disposed at least partially axially between the first cyclone chamber and the suction motor.

In any embodiment the first cooperating alignment member may comprise first and second abutment members provided on opposed sides of the upper section and the second cooperating alignment member may comprise a stop member provided on the surface cleaning head.

In any embodiment the stop member may comprise a cowling surrounding a portion of the upper section when the upper section is in the storage position.

In any embodiment the cowling may be fixedly mounted to the surface cleaning head.

In any embodiment the first and second abutment members may be integrally formed with a part of the upper section.

In any embodiment the anti-rotation locking mechanism may comprise abutment members having abutment surfaces that are fixedly mounted to the upper section and to the surface cleaning head.

In accordance with another aspect, there is provided, an upright surface cleaning apparatus having a front, a rear and opposed lateral sides may comprise a surface cleaning head having a dirt inlet, an upper section that is moveably mounted to the surface cleaning head between an floor cleaning position and a storage position. The surface cleaning head may be rotationally mounted to the surface cleaning head and the upper section is moveable into the storage position when the upper section is in a particular orientation. An air flow path may extend from the dirt inlet to a clean air outlet with a suction motor and a treatment member provided in the air flow path. The upright surface cleaning apparatus may also comprise an anti-rotation locking mechanism automatically that is operably engaged when the upper section is moved into the storage position and an alignment mechanism comprising a first cooperating alignment member associated with the surface cleaning head and a second cooperating alignment member associated with the upper section. The first and second cooperating alignment members may guide the upper section to the particular orientation when the upper section is moved into the storage position.

An embodiment in accordance with this aspect may use any one or more of the optional embodiments discussed with respect to the first aspect.

DRAWINGS

In the detailed description, reference will be made to the following drawings, in which.

DESCRIPTION OF VARIOUS EXAMPLES

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

The following description describes various embodiments of an upright surface cleaning apparatus, for example an upright vacuum cleaner, carpet extractor or the like. The upright surface cleaning apparatus generally comprises an upper section that is movably connected to a surface cleaning head. The upper section (also referred to as a support structure, backbone or handle) is moveable between a storage position and a floor cleaning position. Preferably, in the floor cleaning position the upper section can be pivoted and rotated relative to the surface cleaning head. When moved into the storage position, the upper section is preferably guided into a particular storage orientation, relative to the surface cleaning head, and is automatically locked in place by an anti-rotation locking mechanism. Moving the upper section from the storage position to the floor cleaning position may automatically unlock the anti-rotation locking mechanism, enabling rotation of the upper section when in use. A cleaning unit, preferably containing a suction motor and an air treatment member, is optionally removably attached to the upper section. It will be appreciated that the upright surface cleaning apparatus may be of various designs known in the art. For example, it may use various structures for the surface cleaning head and the upper section, it may use various air treatment members and may have various attachments and options known in the art.

Figure 1:
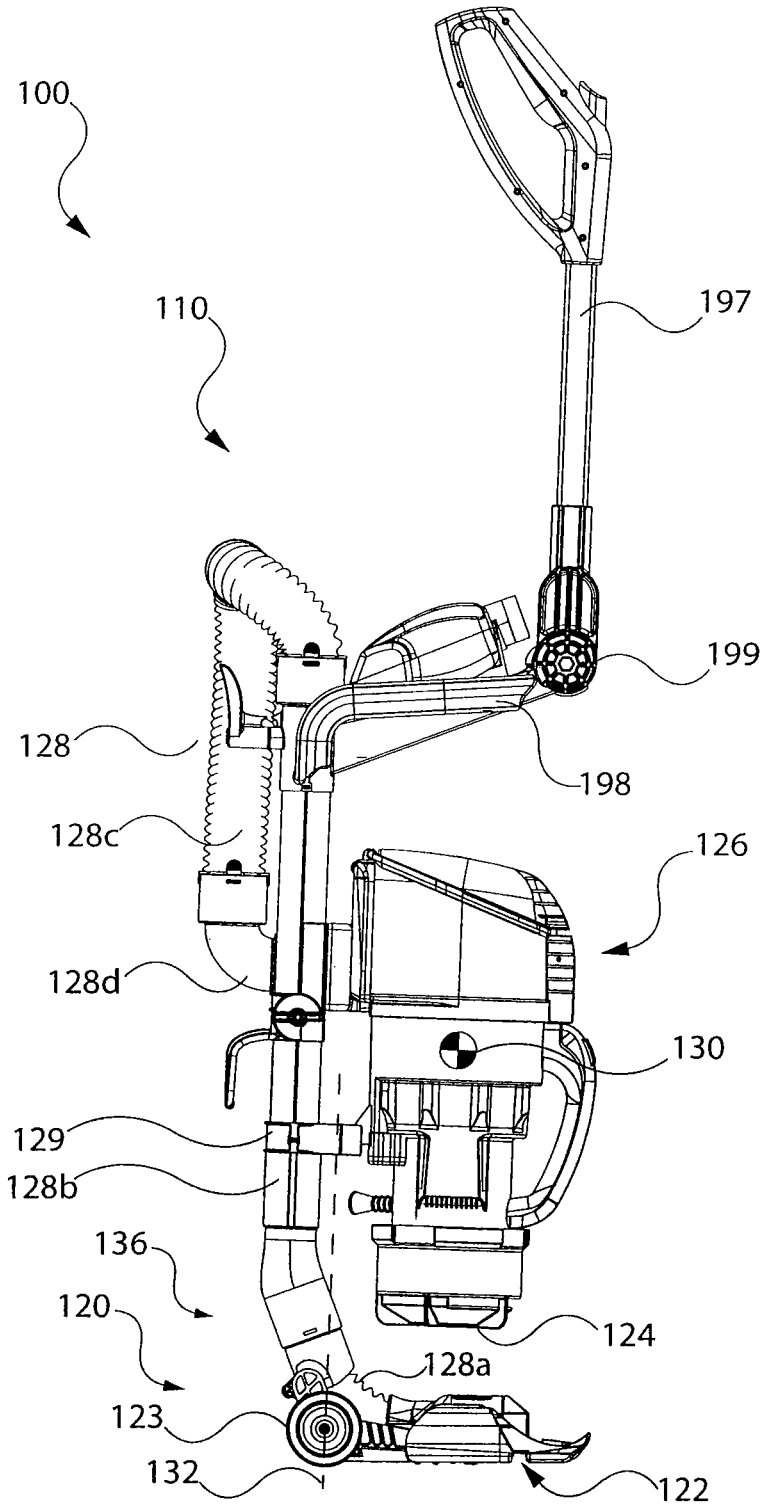
FIG. 1 is a side elevation view of an upright surface cleaning apparatus.
Figure 2:
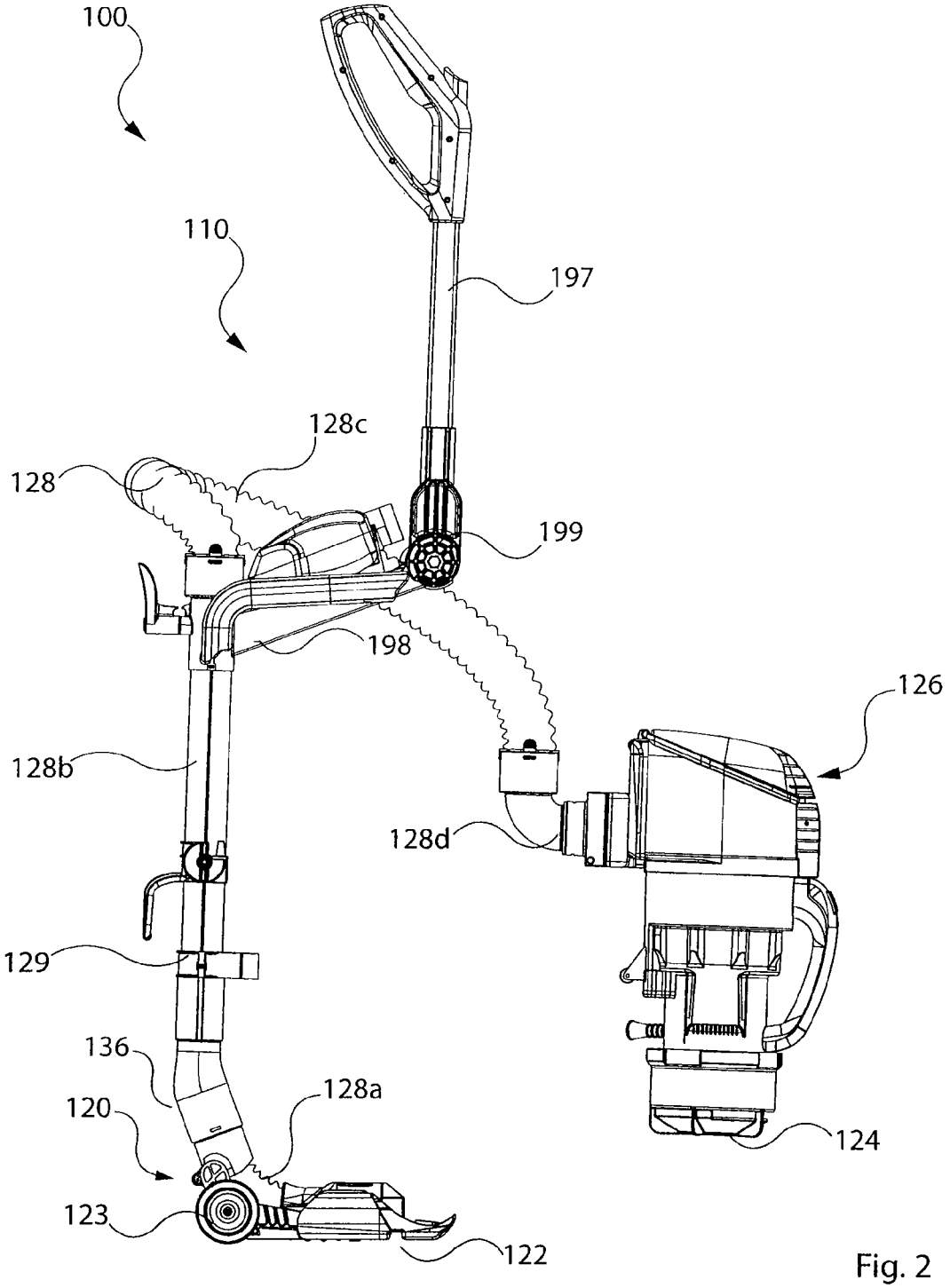
FIG. 2 is a side elevation view of the upright surface cleaning apparatus of FIG. 1 in an alternate configuration.
Figure 3:
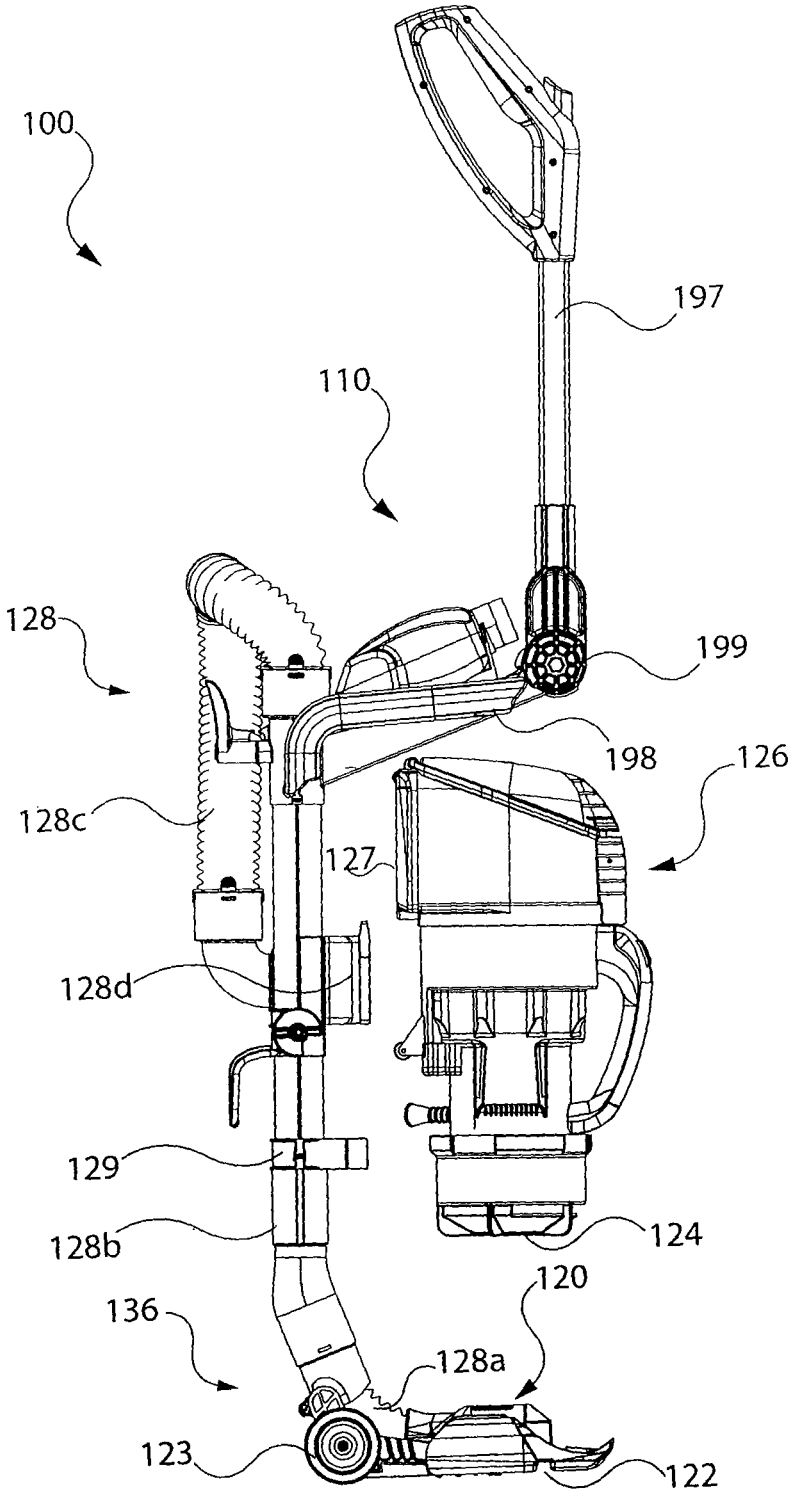
FIG. 3 is a side elevation view of the upright surface cleaning apparatus of FIG. 1 in a further alternate configuration.

FIGS. 1-3 exemplify an upright surface cleaning apparatus. In the present example the upright surface cleaning apparatus is an upright vacuum cleaner 100 comprising an upper section 110 movably connected to a surface cleaning head 120 via a coupling portion 136. The term coupling portion 136 is used to generally describe elements of the vacuum cleaner 100 that are associated with region where the upper section 110 is joined to the surface cleaning head 120 and is not limited to any particular embodiment or assembly of parts. The coupling portion 136 may include multiple structural components or portions of both the upper section 110 and the surface cleaning head 120 as well as additional elements described in more detail below.

As exemplified, the surface cleaning head 120 comprises a dirt inlet 122 for sucking in dirt from the surface being cleaned and a pair of rear wheels 123, located behind the dirt inlet 122, for rollably engaging the surface being cleaned. In some examples, the surface cleaning head may include additional support wheels. The surface cleaning head 120 has a front end 190, a rear end 192 and opposed lateral sides 194, 196 (see FIG. 4).

Figure 8:
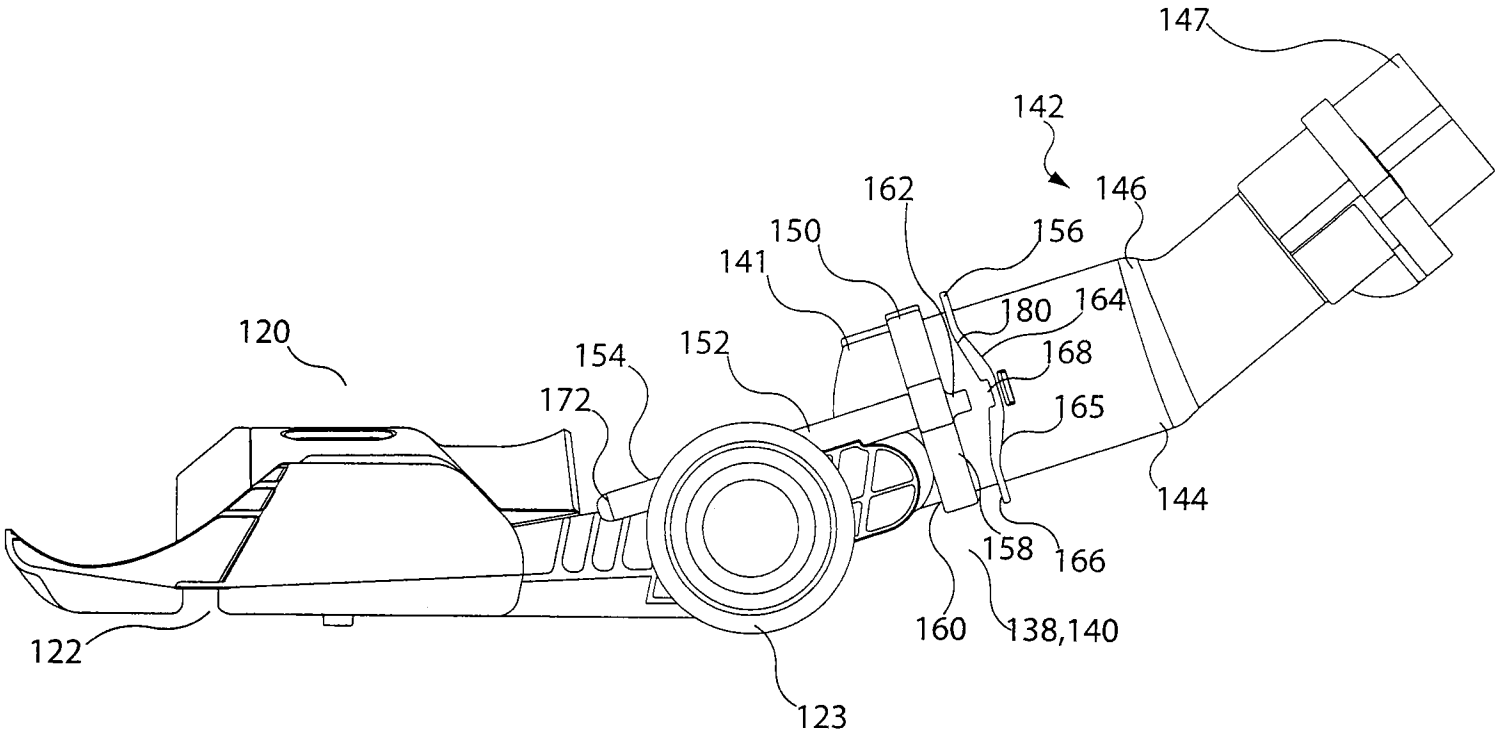
FIG. 8 is a side elevation view of the coupling portion of in the orientation of FIG. 5.

The upper section 110 is movably connected to the surface cleaning head 120 such that the upper section 110 can be moved between an upright, storage position (as exemplified in FIG. 1) and an angle or declined or floor cleaning position (as exemplified in FIG. 8). Preferably, the upper section 110 is pivotally mounted to surface cleaning head 120. In the present example, the upper section 110 is both pivotally and rotatably connected to the surface cleaning head 120 so that the upper section 110 can be both pivoted and rotated relative to the surface cleaning head 120 while the surface cleaning head 120 travels along a surface being cleaned (for example a floor).

The vacuum cleaner 100 also comprises a suction motor and an air treatment member for drawing dirty air from the floor, removing at least a portion the entrained dirt and exhausting clean (or at least relatively cleaner) air into the surrounding environment. In the present example the suction motor and treatment member are combined to within a generally self-contained cleaning unit 126. As exemplified in FIGS. 1-3, the cleaning unit 126 is a removably mounted portable surface cleaning apparatus, preferably a hand vacuum cleaner, wherein the cleaning unit optionally has a nozzle that may be an open sided air flow chamber for directly engaging a surface to be cleaned. It will be appreciated that the portable surface cleaning apparatus may be of any construction and may use any particular air treatment member (e.g. one or more cyclones comprising one or more cyclonic cleaning stages and/or one or more filters). It will also be appreciated that the upper section to which the portable surface cleaning apparatus is removably attached may be of any particular design and is preferably bendable between the upper end 197 and the lower end 198 of the upright structure (e.g., about pivot 199). Further, the cleaning unit 126 may alternately, or in addition, include an open sided nozzle that may selectively receive an auxiliary cleaning tool (for example a flexible hose, a cleaning wand, an air powered brush apparatus, a crevice tool or any other suitable attachment or combination thereof).

In other examples, the cleaning unit 126 need not be a portable surface cleaning apparatus having a dirty air inlet for cleaning a surface. Instead it may be a cleaning unit 126 that is fixedly attached to the upper section 110. For example, it may comprise a housing that houses a suction motor and one or more air treatment members (e.g., one or more cyclones with one or more filters). Such a cleaning unit does not have a dirty air inlet adapted to clean a floor. Instead, it is configured to receive dirty air conveyed from the surface cleaning head 120, as described below. In other examples, it will be appreciated that the suction motor may be provided in the surface cleaning head.

Vacuum cleaner 100 also comprises a fluid flow path 128 (also referred to as an air flow path or air flow conduit) that operatively connects the dirty air inlet 122 (also referred to as a dirt inlet, an air inlet or a suction inlet) on the surface cleaning head 120 with a clean air outlet 124 (also referred to as an exhaust) downstream of the suction motor, e.g., on the cleaning unit 126. As exemplified in FIGS. 1-3, the fluid flow path 128 comprises a lower flexible hose 128*a*, a rigid conduit 128*b*, an upper flexible hose 128*c* and a cleaning unit attachment member 128*d* that cooperate to create a continuous air flow conduit extending from the surface cleaning head 120 to the cleaning unit 126. The fluid flow path 128 may also comprise other portions of the upper section 110, for example the rotational coupling member 142 described below. In other examples, the fluid flow path 128 may comprise a different combination of flexible and rigid conduits or may be formed form a single type of conduit (i.e. all flexible or all rigid).

In accordance with a first aspect, the cleaning unit 126 is removably mounted to the upper section 110 and the upright vacuum cleaning is operable in at least two configurations and optionally in three configurations. In a first configuration the cleaning unit 126 is mounted to upper section 110, in a second configuration the cleaning unit 126 is removed from the support structure but remains in air flow communication with the surface cleaning head 120 and in a third configuration the cleaning unit 126 is detached from the upper section 110 and does not remain in air flow communication with the surface cleaning head 120.

In the first configuration, as exemplified in FIG. 1, the vacuum cleaner 100 can be operated with the cleaning unit 126 mounted to the lower portion of the upper section 110 using the attachment member 128*d*. In this configuration the cleaning unit 126 is supported by the upper section 110 and the vacuum cleaner 100 can be operated as an upright vacuum cleaner. In some examples, a portion of the load of the cleaning unit is optionally also supported by a mount bracket 129, which receives and supports another part of cleaning unit 126, such as optional rear wheel of the cleaning unit 126 when the cleaning unit is a hand vacuum cleaner.

In a second configuration, as exemplified in FIG. 2, the surface cleaning unit is detached from the upper section 110 but remains in fluid communication with the surface cleaning head 120 via, e.g., flexible hose 128*c* and attachment member 128*d*. In this configuration, the cleaning unit 126 may be carried by the user (or rested on the floor or other surface) while still serving as the vacuum or suction source for the vacuum cleaner 100.

In a third configuration, as exemplified in FIG. 3, the cleaning unit 126 is detached from the upper section 110 and from fluid communication with surface cleaning head 120. The cleaning unit 126 may have a nozzle and be a portable surface cleaning apparatus, such as a hand vacuum cleaner. As exemplified in FIG. 3, the cleaning unit 126 may be uncoupled from the attachment member 128*d* (which remains attached to the upper section 110) and can be used independently as a portable cleaning apparatus or a hand vacuum using nozzle 127 as a dirt inlet.

In some examples, the upper section 110 may include a housing, recess, casing or shell that surrounds at least a portion of the cleaning unit 126 when the cleaning unit 126 is mounted on the upper section 110. In other preferred examples, as exemplified in FIGS. 1-3, upper section 110 has an absence of a housing defining a recess for receiving the cleaning unit 126 so that the cleaning unit 126 is not retrained within a recess (or cavity or void) in an outer housing or other portion of the upper section 110. For example, no molded plastic shell may be provided that houses operating components of the vacuum cleaner and includes a recess for receiving the cleaning unit 126.

In accordance with a second aspect, which may be used by itself or with any one or more other aspects, the upper section is rotationally mounted to the surface cleaning head and is moveable between a storage position and a floor cleaning position. The storage position includes one or more particular orientations of the support structure relative to the surface cleaning head that are stable and desirable for storage purposes. In some instances, the support structure may tend to rotate from the desired orientation into another orientation when a user releases the handle of support structure. To inhibit unwanted rotation of the support structure relative to the surface cleaning head, the upright vacuum cleaning includes an anti-rotation locking mechanism that locks (or fixes or otherwise secures) the orientation of the support structure relative to the surface cleaning head. It will be appreciated that the anti-rotation locking mechanism may secure the upper section in only one position or alternately in more than one position provided that each such position is stable. The anti-rotation locking mechanism is automatically engaged when the upper section 110 is moved to the storage position and automatically disengaged when the upper section is moved to a floor cleaning position.

In accordance with a third aspect, which may be used by itself or with any one or more other aspects, the upper section is rotationally mounted to the surface cleaning head and is moveable between a storage and a floor cleaning position. The storage position includes one or more particular orientations of the support structure relative to the surface cleaning head that are stable and desirable for storage purposes. To inhibit unwanted rotation of the support structure relative to the surface cleaning head, the upright vacuum cleaning includes an anti-rotation locking mechanism that locks the orientation of the support structure relative to the surface cleaning head and an alignment mechanism to guide the upper section 110 into the storage position.

In some examples, as exemplified in FIG. 1, the cleaning unit 126 may contain a majority of the mass of the vacuum cleaner 100 which can result in the center of gravity of the entire vacuum cleaner 100 (including the mass of the upper section 110 and the cleaning unit 126) being located within the cleaning unit 126. A schematic representation of the center of gravity 130 of the vacuum cleaner 100 is illustrated in FIG. 1 for illustrative purposes only and is not intended to precisely define the location of the center of gravity of the vacuum cleaner 100. The vacuum cleaner 100 also defines a pivot axis plane 132, which is defined as the vertical plane that extends perpendicular to the horizontal axis of rotation 133 of the pivot connection between the upper section 110 and the surface cleaning head 120.

In the example illustrated, when the vacuum cleaner 100 is in the storage position (as shown in FIG. 1) the center of gravity 130 of the vacuum cleaner 100 is in front of, or forward of, the pivot axis plane 132 and above the surface cleaning head 120. In this particular orientation, the vacuum cleaner 100 is in a generally stable condition. That is, in the absence of an external force (for example a force applied by a user) the vacuum cleaner 100 will tend to stay in the storage position instead of leaning, tipping or falling toward the floor. In this example, the vacuum cleaner 100 will tend to stay in the storage position until the user applies an external force. In other examples, the center of gravity 130 may be located on, or behind, the pivot axis plane 132. In these examples, the upper section 110 of the vacuum cleaner 100 may tend to fall out of the storage position if not adequately secured using a pivot-locking or restraining apparatus, for example a pin, a clip, a friction fit, a foot activated lever or a resilient biasing means. If desired, any known pivot-locking apparatus may be used in any embodiment.

Figure 4:
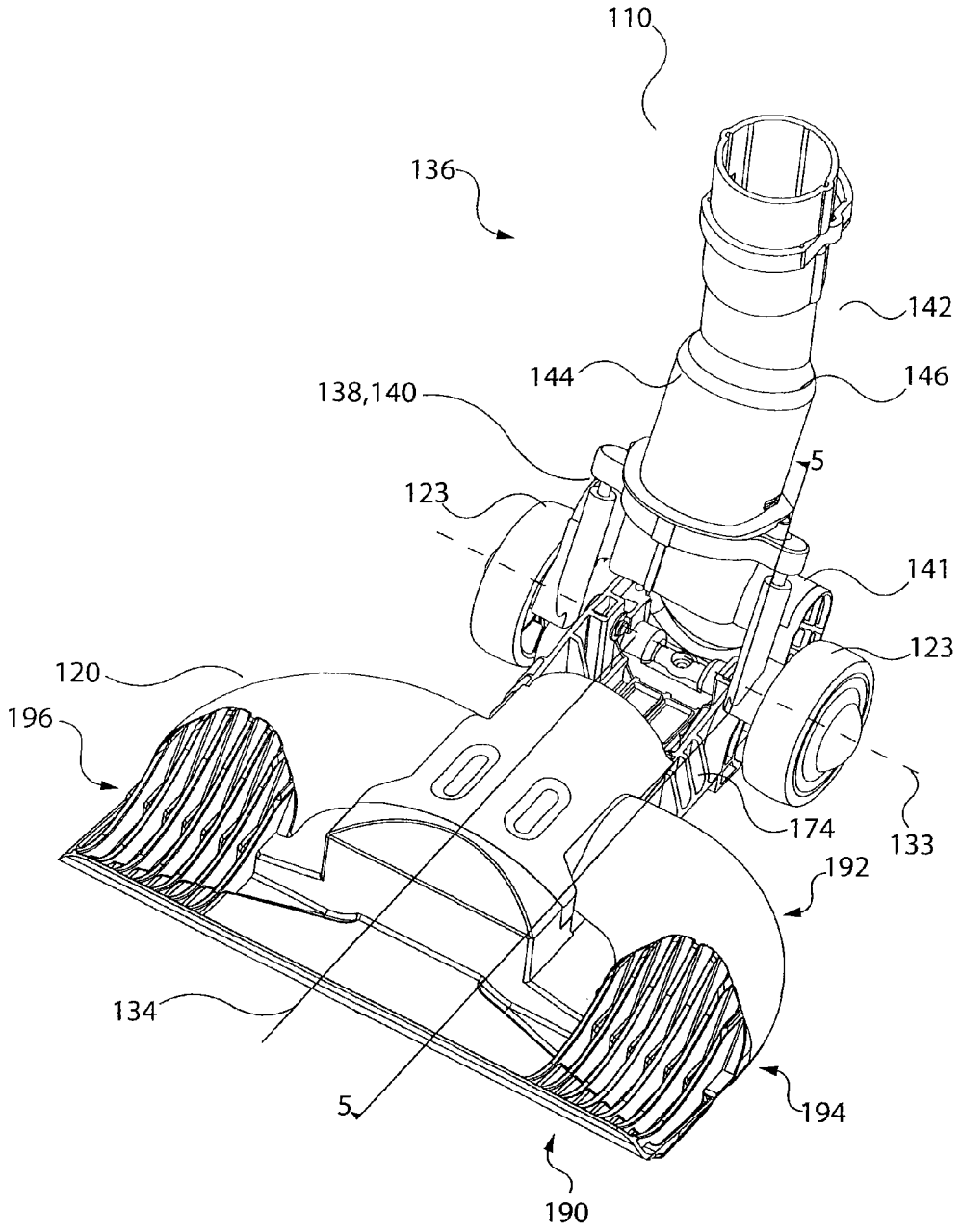
FIG. 4 is a front isometric view of a coupling portion of the upright surface cleaning apparatus of FIG. 1 in a storage position.

In some examples, alternately or in addition to positioning the center of gravity 130 in a front-back position (i.e. relative to the pivot axis plane 132), moving the upper section 110 into the storage position may also include registering the center of gravity 130 in the side-to-side direction (i.e. relative to a centerline plane 134 exemplified in FIG. 4 that is perpendicular to the pivot axis plane 132). Registering or orienting the center of gravity 130 relative to the centerline plane 134 when storing the vacuum cleaner 100 may be advantageous because if the center of gravity 130 is outside the centerline plane 134, or too far from the centerline plane 134, when the vacuum cleaner 100 is in the storage position the vacuum cleaner 100 may tend to be unbalanced or unstable and may tip over in the lateral or sideways direction.

A vacuum cleaner 100 that is prone to tipping over when in the storage position (forward, backward or laterally) or an upper section 110 that tends to fall from the storage position into the floor cleaning position without user intervention may pose a safety hazard and may damage itself or other items when it falls. Positioning or orienting the center of gravity 130 within the centerline plane 134 or a range thereof, and optionally in front of the pivot axis plane 132, may reduce the likelihood that the vacuum cleaner 100 will tip or fall over when in the storage position. In some examples, the proper positioning of the center of gravity 130 is achieved using an alignment mechanism described below.

In addition to properly locating or aligning the center of gravity 130, when the vacuum cleaner is in the storage position it is preferred to lock (or otherwise secure) the upper section 110 in a fixed rotational position or orientation relative to the surface cleaning head 120 so that the upper section 110 will not auto-rotate (thereby moving the center of gravity 130 out of the centerline plane 134) when placed in the storage position and released by the user. The upper section 110 is positioned in the proper rotational position by using an anti-rotation locking mechanism. With the center of gravity 130 properly located and locked in position, as described above, the vacuum cleaner 100 may be considered stable when in its storage position and may be able to resist small impacts without tipping, for example being accidentally bumped or jostled by a user.

Preferably, for ease of use, the anti-rotation locking mechanism automatically engages or activates when the upper section 110 is pivoted into the storage position, and, more preferably, also automatically disengages or deactivates when the upper section 110 is pivoted into the floor cleaning position.

Referring to FIGS. 4-10, a first example of a coupling portion 136 used to connect the upper section 110 to the surface cleaning head 120 is illustrated comprising an anti-rotation locking mechanism 140, a mounting member 141 and a rotational coupling member 142.

As exemplified in FIGS. 4-10, to enable the desired range of movement when the vacuum cleaner 100 is in use (i.e. when the upper section 110 is in a floor cleaning position) the mounting member 141 is pivotally connected to the surface cleaning head 120 so that it can pivot about pivot axis 133 between the storage position (as illustrated in FIG. 4) and a floor cleaning position (as illustrated in FIG. 8). In the example illustrated in FIGS. 4-10 the pivot axis 133 coincides with the axis of rotation of the wheels 123 of the surface cleaning head 120. In other examples (as exemplified in FIG. 10), the pivot axis 133 may be separate from the axis of rotation of the wheels 123. The pivot connection between the upper section 110 and the surface cleaning head 120 may be any type of suitable pivot joint, including a pin joint, an axle or a bearing.

In addition to pivoting about the pivot axis 133, the rotational coupling member 142 is rotatably coupled to the mounting member 141 so that the rotational coupling member 142 can rotate relative to the mounting member 141. The rotatable connection between the rotational coupling member 142 and the mounting member 141 can be any suitable rotatable joint or coupling known by those skilled in the art.

In some examples the rotational coupling member 142 is a portion of the upper section 110 and is integrally formed therewith. In other examples, the rotational coupling member 142 is a separate member that is coupled or connected to a lower end of the upper section 110. Accordingly, in some examples, elements or features described as being part of the rotation coupling member 142 may form part of the upper section 110.

As exemplified in FIGS. 4-10, the rotational coupling member 142 comprises a longitudinally extending member 144, an optional elbow 146 and an upper end 147 upstream from the longitudinally extending member 144. Other examples may include elbows 146 having a greater or smaller bend, or may not include an elbow portion at all (i.e. the rotational coupling member 142 may be a straight member). Elbow 146 assists in positioning upper section at an angle forward of plane 132 (i.e., at an angle of greater than 90° from the horizontal). The rotational coupling member 142 may be a separate element from the up flow duct or may be part thereof.

Figure 7:
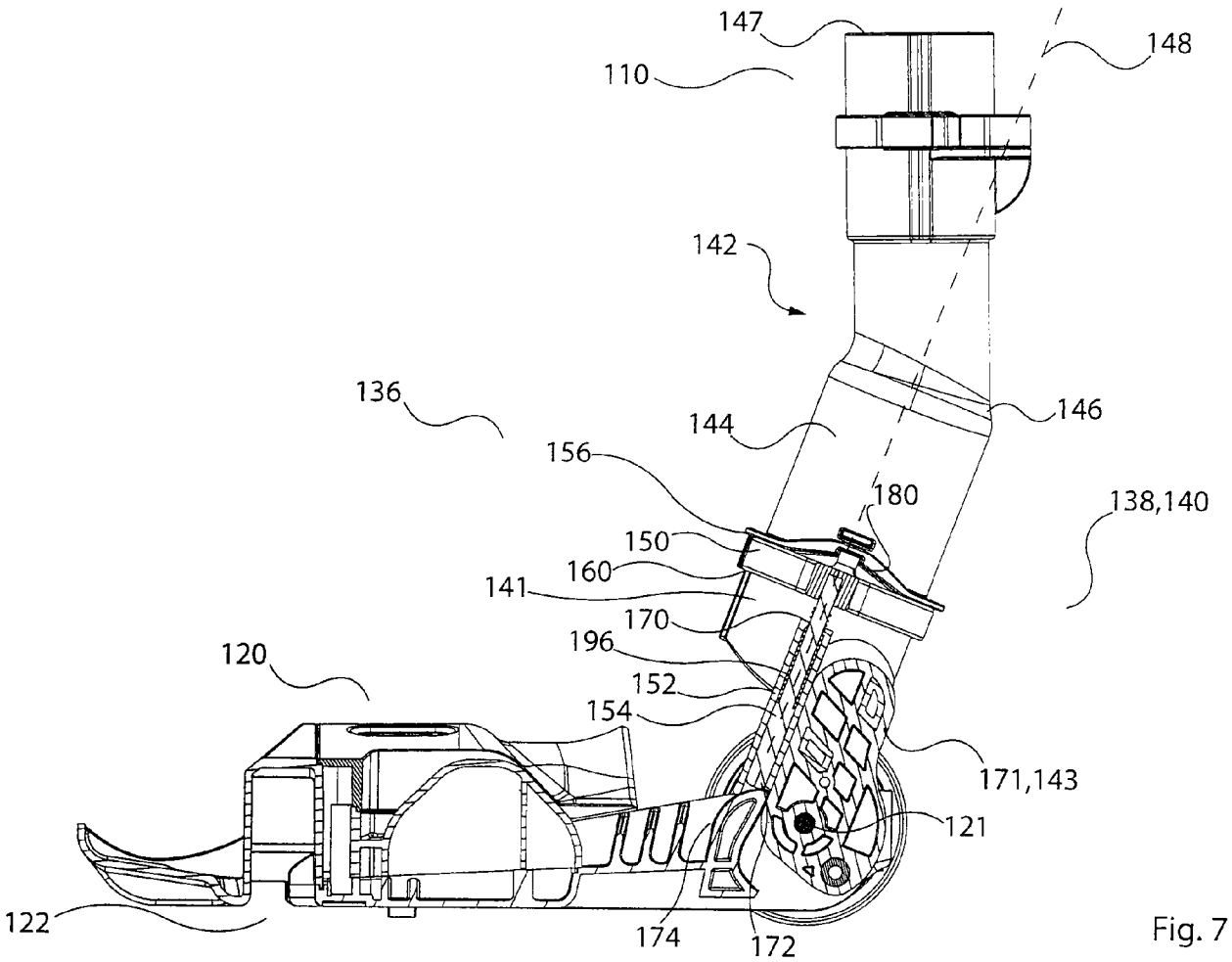
FIG. 7 is a partial section view of the coupling portion in the orientation of FIG. 4.

The longitudinally extending member 144 of the rotational coupling member 142 defines a longitudinal axis 148, about which the rotational coupling member 142 can rotate (see FIG. 7). As shown in this embodiment, it is preferred that at least a portion of the longitudinal axis 148 lies within, or extends through a portion of the air flow path 128. The longitudinally extending member 144 also comprises a hollow tube-like or pipe-like configuration having an inner diameter that is slightly larger than the outer diameter of a portion of the mounting member 141. Accordingly, at least a portion of the mounting member 141 is telescopingly received within the longitudinally extending member 144 of the rotational coupling member 142 providing support for and allowing relative rotation of the rotational coupling member 142. The upper end 147 is configured to be connected a portion of the upper section 110, for example rigid conduit **128*b***.

In the present example, the rotational coupling member 142 also comprises, and cooperates with the hollow portion of the mounting member 141 to define, an up flow conduit or up flow duct that forms part of the fluid flow path 128. In other examples, the air flow or fluid flow path 128 may be entirely or at least partially separate from the coupling portion 136.

To secure the rotational coupling member 142 (and the rest of the upper section 110 attached thereto) in the desired storage position, in which the center of gravity 130 is properly registered, an anti-rotation locking mechanism 140 is operable to selectively fix the rotational position of the rotational coupling member 142 relative to the mounting member 141 and the surface cleaning head 120. As exemplified in FIGS. 4-10, a first example of the anti-rotation locking mechanism comprises a locking ring 150, a pair of support posts 152, a pair of engagement members, for example locking pins 154, that are movably received within a respective support post 152 and a pair of receiving members 156.

The locking ring 150 is a generally annular ring having an internal opening that is sized and shaped to slidingly receive a portion of the mounting member 141 (and/or a portion of the rotational coupling member 142 in some examples). While the locking ring 150 is slidable relative to the mounting member 141 in the longitudinal direction (i.e. along the longitudinal axis 148), the locking ring 150 is also connected to the locking pins 154 received within the support posts 152, which prevents the locking ring 150 from rotating relative to the mounting member 141. The locking ring 150 is moveable between an engaged or locked position, shown in FIGS. 4, 6 and 7, and a disengaged or unlocked position, shown in FIGS. 5, 8 and 9.

While shown as being generally circular in the present example, it is understood that the locking ring 150 may be of any shape and is preferably complimentary to the mounting member 141 and/or rotational coupling member 142. The locking ring 150 has an upper face 158, an opposed lower face 160 and a pair of upwardly extending projections 162, extending from its upper face 158. In the example shown, the locking ring 150 comprises two, upward facing projections (also referred to as studs, protrusions or bosses) located on opposed sides of the vacuum cleaner 100, e.g. that are spaced approximately 180° apart and preferably on the opposed lateral sides of the vacuum cleaner. In other examples, the locking ring 150 may comprises a greater or fewer number of upwardly extending projections and the projections may be spaced in any suitable arrangement around the periphery or edge of the locking ring.

In addition to sliding along the rotational coupling member 142, the locking ring 150, and the upward facing projections 162, are designed to engage with complimentary locking members 168 of the receiving members 156. In the present example, the receiving members 156 comprise portions of a generally continuous annular flange 164 that extend from the longitudinally extending member 144 (or other portion of the upper section 110). The annular flange 164 comprises an upper face 165, a lower face 166 and a pair of notches 168 (also referred to as gaps, cut-outs or recesses) defined in the lower face 166 comprise the complimentary locking members. The number and location of the notches 168 formed in the lower face 166 of the receiving member 156 is preferably based on the number, size and position of the corresponding projections 162 on the locking ring 150. In the present example, the locking ring 150 comprises two upward facing projections 162 and each receiving member 156 comprises a corresponding notch 168. The notches 168 are sized to receive the upward facing projections 162 so that when the locking ring 150 is moved to the engaged or locked position the projections 162 are received within their respective notches 168 and the locking ring upper face 158 abuts the flange lower face 166.

With the projections 162 substantially received with the notches 168, the angular position of the rotational coupling member 142 is fixed relative to the locking ring 150 and therefore relative rotation between the rotational coupling member 142 and the mounting member 141 is inhibited. As exemplified, the notches 168 may extend through only a portion of the receiving member 156, thereby forming a recess or blind-holes in the flange lower face 166. In other examples, the notches 168 may have a different depth (i.e. extending more or less into the receiving member 156) or may comprise through-holes or apertures that extend completely through the receiving member 156, connecting the upper and lower flange faces 165, 166.

In the present example, the locking ring 150 is supported by two, spaced apart engagement members, the locking pins 154 that are slidably received within respective support posts 152. The support posts 152 are pivotally connected to the surface cleaning head 120 and preferably secured to the mounting member 141 so that the angular position of the support posts 152 automatically changes with the position of the mounting member 141 as the vacuum cleaner 100 is moved from the storage position to the floor cleaning position, and vice versa. This connection between the support posts 152 and the mounting member 141 may be created using any suitable means known in the art. In one example of this connection, as best exemplified in FIG. 10, each support post 152 includes an integral mounting flange 171 that is connected to a complimentary landing flange 143 portion of the mounting member 141. The mounting flanges 171 are connected to the landing flanges 143 so that they will move in unison, and both the landing flanges 143 and the mounting flanges 171 are pivotally connected to the surface cleaning head 120 using pins 121. The mounting flanges 171 may be connected to the landing flanges 143 using a press fit, an adhesive, a mechanical fastener or any other suitable fastening means known in the art. In this example, when the coupling portion 136 is assembled, the pins 121 extend outward, beyond the mounting flanges 171 and serve as the axels that rotatably support the rear wheels 123. In other examples, the pins 121 may be separate from the axels supporting the rear wheels 123.

Each support post 152 also comprises a generally planar upper face 170 that generally opposes a portion of the locking ring lower face 160. In use, upward movement of the locking ring 150 may be limited by the contact between the locking ring upper face 158 and the flange lower face 166, and downward movement of the locking ring 150 may be limited by contact between the upper faces 170 of the support posts 152 and portions of the locking ring lower face 160.

Each locking pin 154 (also referred to as an engagement member) is movably mounted to the surface cleaning head 120 (via support posts 152 as described above) and comprises an upper or engagement end. The engagement ends of both locking pins 154 are joined and secured together by the locking ring 150. In other examples, the engaging ends of the locking pins 154 may be secured together by a connector other than the locking ring 150. The locking ring maintains the alignment of the engagement end with the notches and assists to cause the locking pins 154 to move concurrently. It will be appreciated that a pair of arcuate connectors may be used or other alignment members that are provided on rotational coupling member 142 may be used. In another embodiment, a locking ring 150 may not be used and the engagement end of locking pins may directly engage notches 158.

Each locking pin 154 also comprises a lower end 172 that functions as a cam follower for engaging a cam member or cam surface 174 on the surface cleaning head 120. The support posts 152 and locking pins 154 are positioned relative to the cam surface 174 such that the lower ends 172 of the locking pins 154 are drivingly associated with the cam surfaces 174.

Figure 5:
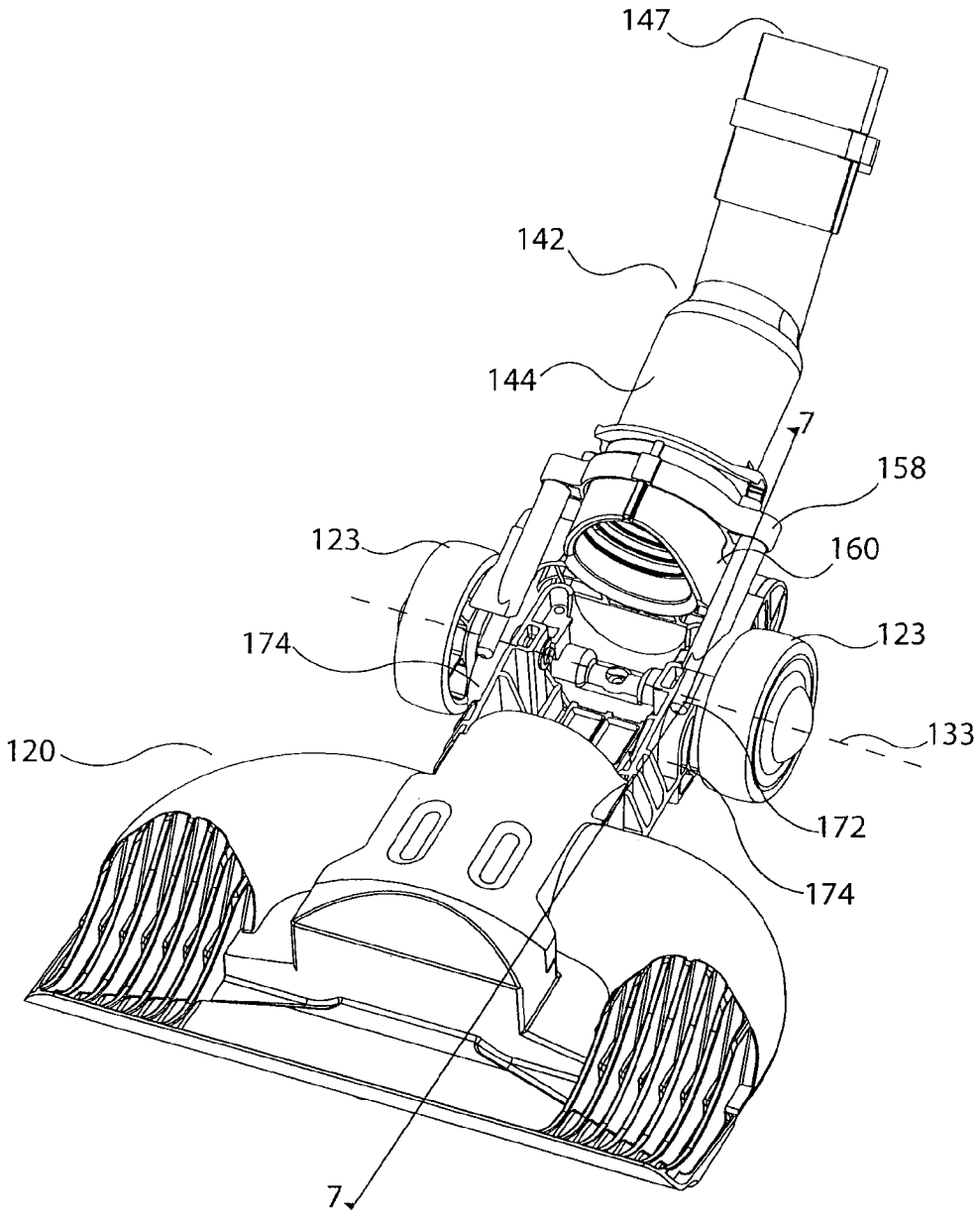
FIG. 5 is a front isometric view of a coupling portion of the upright surface cleaning apparatus of FIG. 1 in a floor cleaning position.
Figure 6:
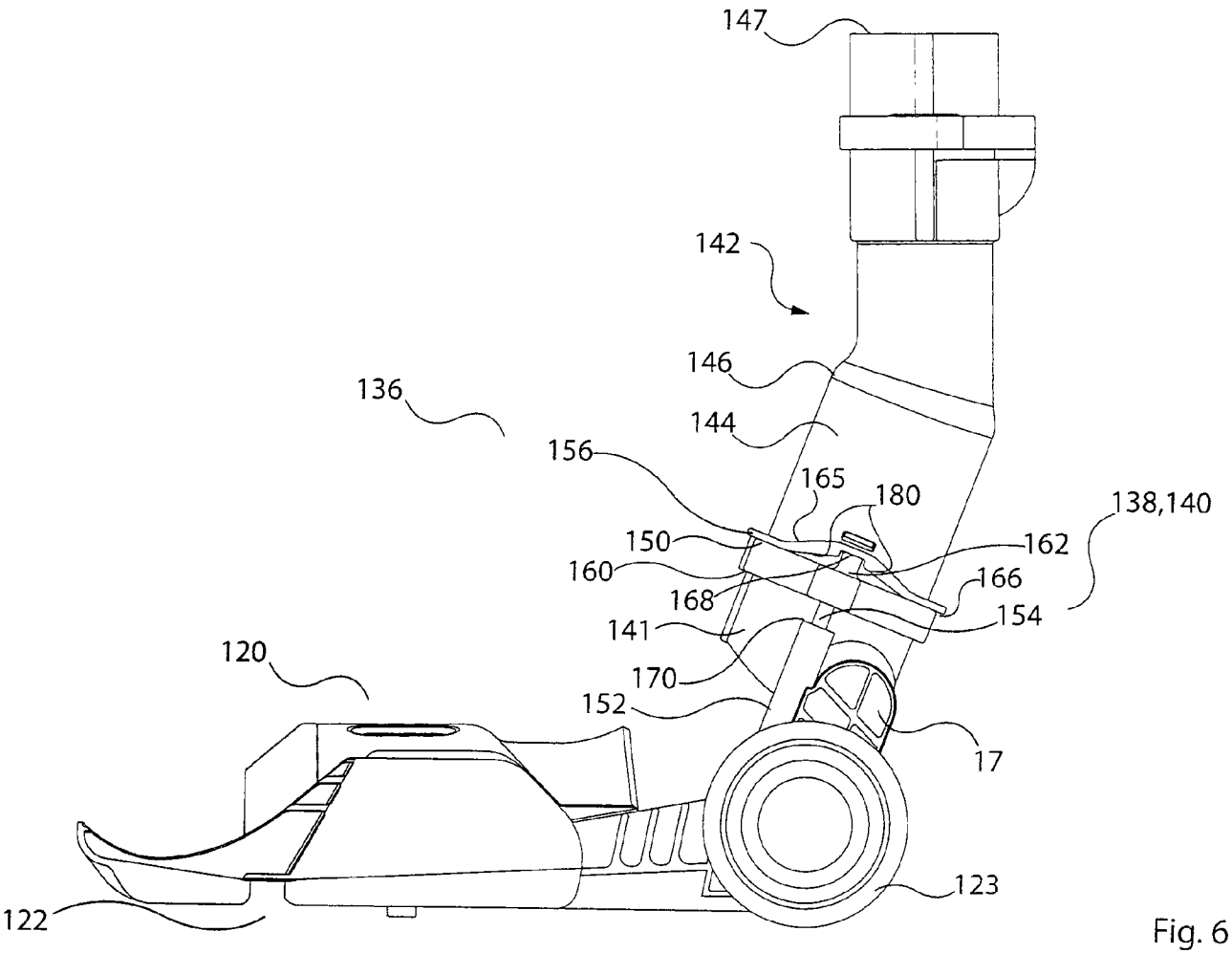
FIG. 6 is a side elevation view of the coupling portion in the orientation of FIG. 4.
Figure 9:
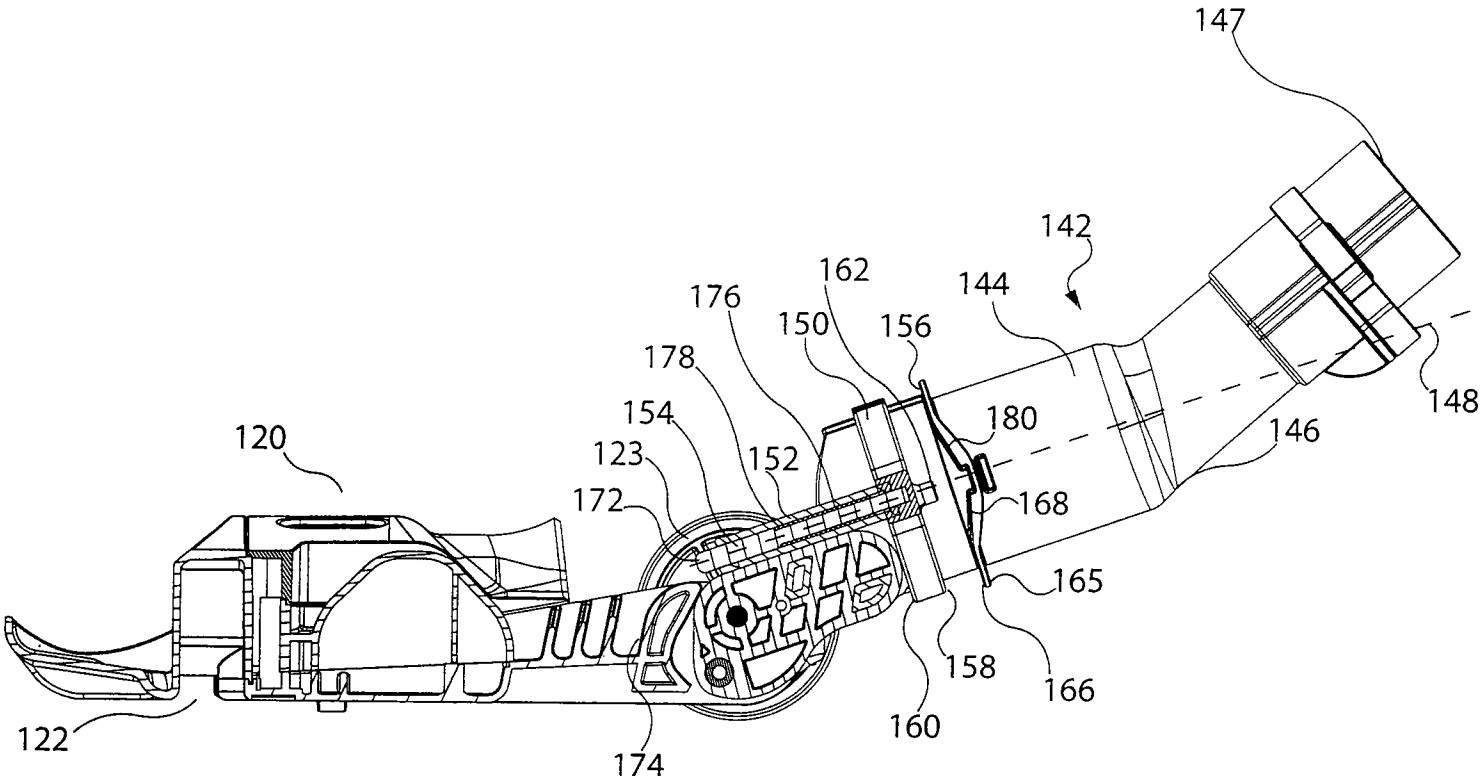
FIG. 9 is a partial section view of the coupling portion in the orientation of FIG. 8.
Figure 10:
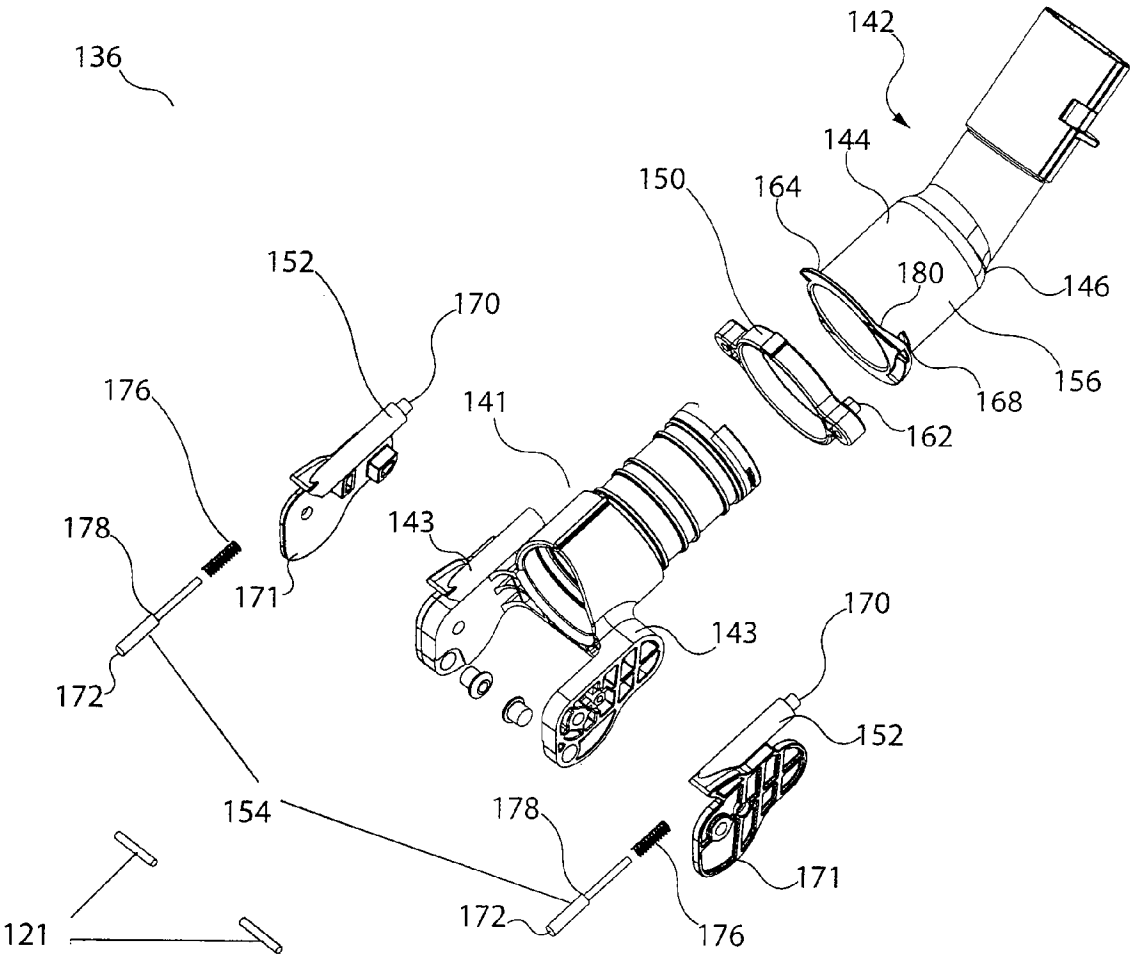
FIG. 10 is an exploded view of the coupling portion of FIG. 4.

Based on the profile of the cam surface 174, the position of the pins 154 changes as the upper section 110 is pivoted between the storage and floor cleaning positions. In the floor cleaning position, the cam surface 174 is shaped so that the pins 154 may automatically move downward, which results in the locking ring 150 moving downward (away from the receiving member 156) toward the unlocked or disengaged position, as shown in FIGS. 5, 8 and 9. Preferably, the locking pins 154 are biased to the unlocked position as exemplified by FIG. 9 due to gravity and/or a biasing member, such as spring 176. When the upper section is pivoted toward the storage position the lower ends 172 of the locking pins 154 are automatically driven upward by the cam surface 174, which results in the locking ring 150 moving upward (toward the receiving member 156).

As exemplified in FIGS. 4-10, the lower ends 172 of the locking pins 154 are preferably rounded or curved to enable the lower end 172 to smoothly slide along the cam surface 174. In other examples, the lower end 172 may have sharp corners or may comprise additional rolling or sliding elements for engaging the cam surface 174.

Preferably, each support post 152 also comprises a spring 176 (or any other suitable biasing means) for biasing the pins 154 downward, toward the unlocked or disengaged position. The inclusion of the springs 176 may increase the likelihood that the pins 154 and locking ring 150 automatically move from the locked position to the unlocked position when the upper section 110 is tilted from the storage position to the floor cleaning position. To facilitate the automatic engagement/disengagement of the anti-rotation locking mechanism 140, the springs 176 exert a continuous, downward biasing force urging the locking pins 154, and therefore the locking ring 150, toward the unlocked position. The downward biasing force may also maintain the driving contact between the lower end 172 of the locking pin 154 and the cam surface 174 on the surface cleaning head 120, which supplies a reaction force, opposing the biasing force of the springs 174. When the upper section 110 is tilted from the storage position, toward the floor cleaning position, the support posts 152 pivot relative to the surface cleaning head 120 which causes the lower end 172 of the locking pins 154 to be urged downward by the spring 176 and to move forward along the cam surface 174. The profile of the cam surface 174 is designed so that as the pin 154 moves along the cam surface 174, the pin 154 slides downward, resulting in a corresponding downward movement of the locking ring 150. This automatic downward movement of the locking ring 150 operatively or functionally disengages the upward facing projections 162 from their respective notches 168 which enables the relative rotation between the rotational coupling member 142 and the mounting member 141, desired during use. It will be appreciated that cam surface 174 may be of various configurations and that pin 154 need not always contact the cam surface 174.

In the present example, each spring 176 is retained at its upper end at the top, or upper end, of the support post 152 while the lower end of the spring 176 rests on a shoulder 178 formed at the connection between the lower end 172 and a narrower, neck portion of the locking pin 154. In other examples, the spring 176, or other biasing means, may be engage in the pin 154 and the support post 152 in any suitable manner, including adhesive connections, tabs or clips.

Referring to FIGS. 11-15, another example of a coupling portion 136, comprising another example of an anti-rotation locking mechanism is illustrated. This example of a coupling portion may be used with the vacuum cleaner 100 to connect the upper section 110 to a surface cleaning head 120. For clarity and ease of description, features of this example that are generally the same as features described with respect to the previous example will be denoted using the same reference numeral, while features of the present example that are analogous to, but structurally different than features of the previous example will be denoted using the references numerals from FIGS. 1-10, particularly FIGS. 4-10, indexed by 100.

Figure 11:
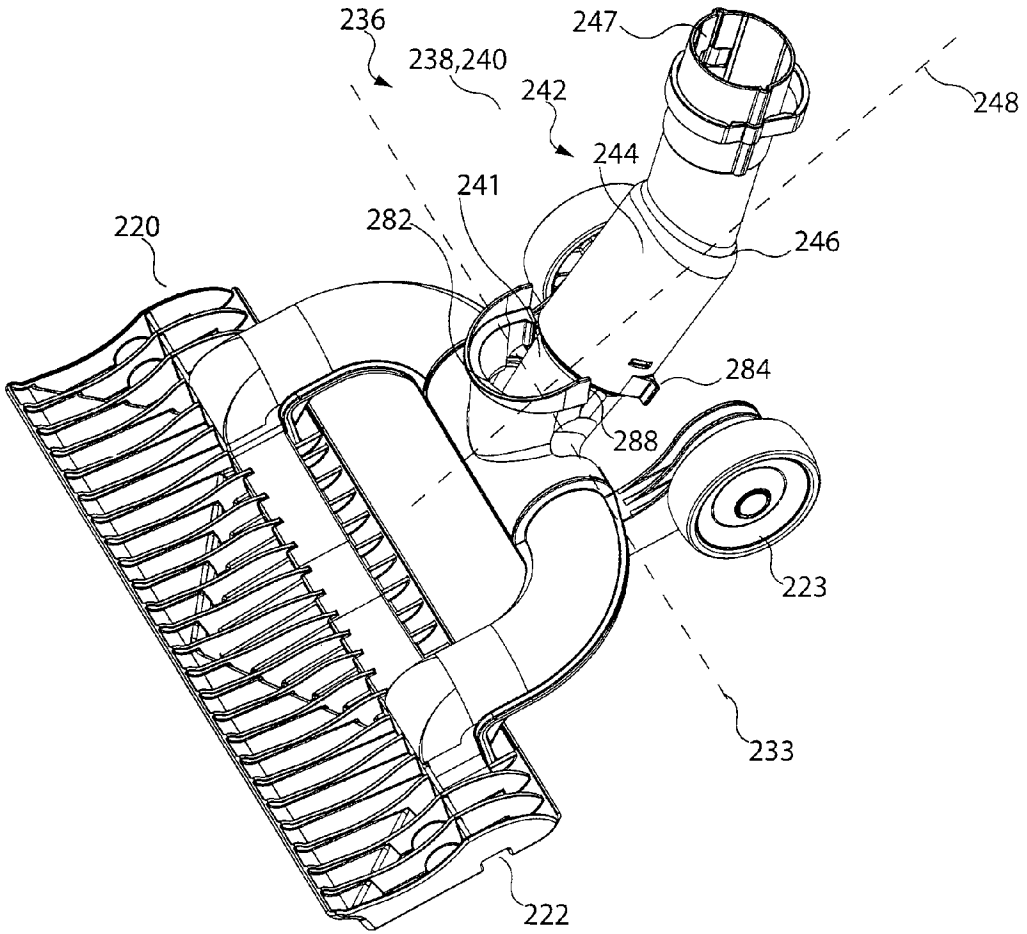
FIG. 11 is a front isometric view of an alternate embodiment of a coupling portion in a floor cleaning position.
Figure 12:
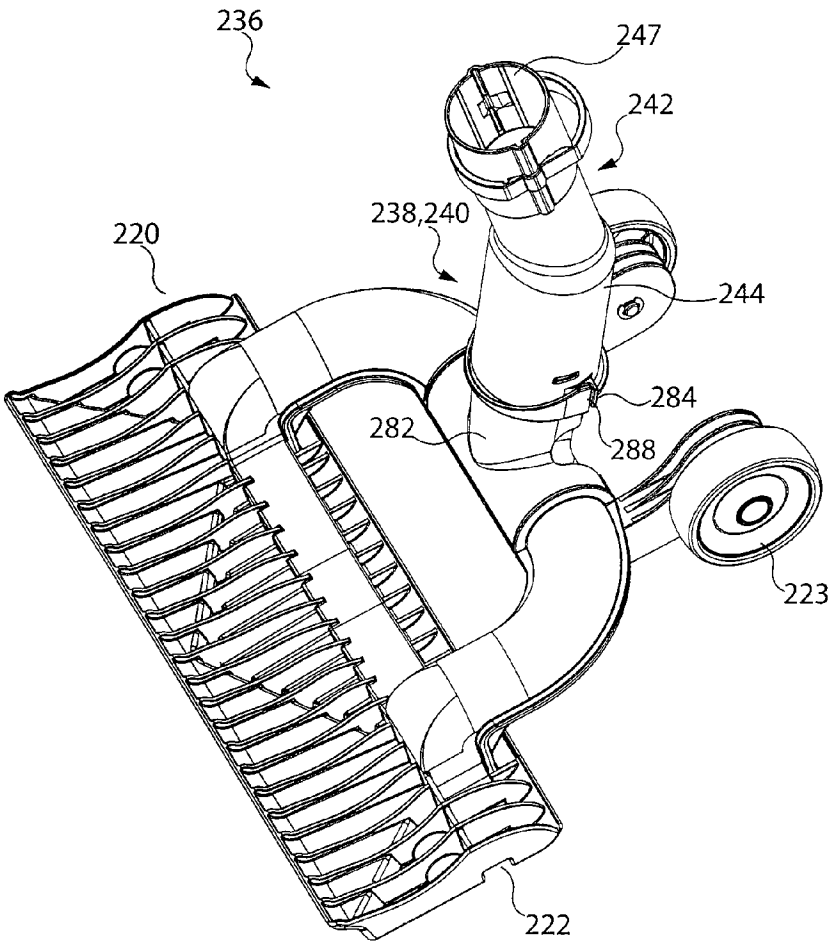
FIG. 12 is a front isometric view of the alternate embodiment of the coupling portion of FIG. 11 in the storage position.
Figure 13:
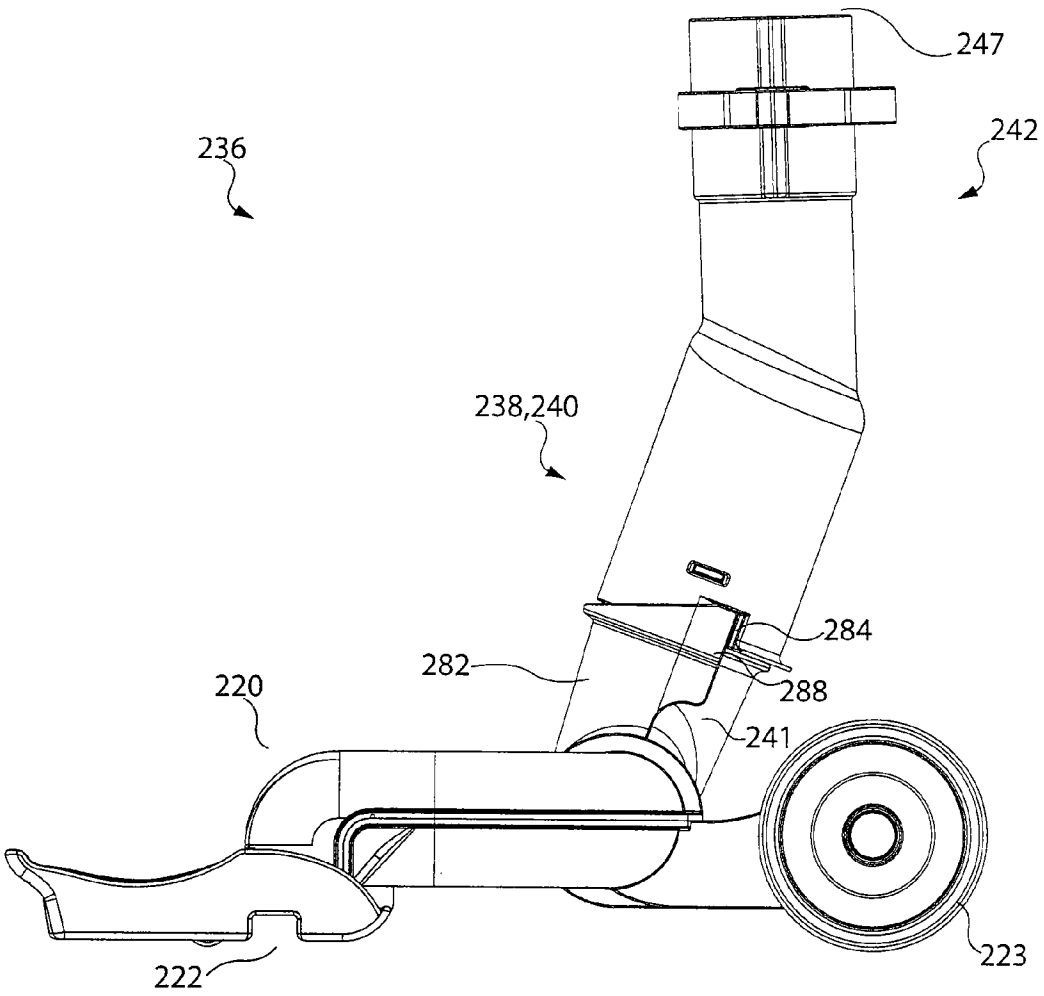
FIG. 13 is a side elevation view of the alternate embodiment of the coupling portion in the orientation of FIG. 12.
Figure 14:
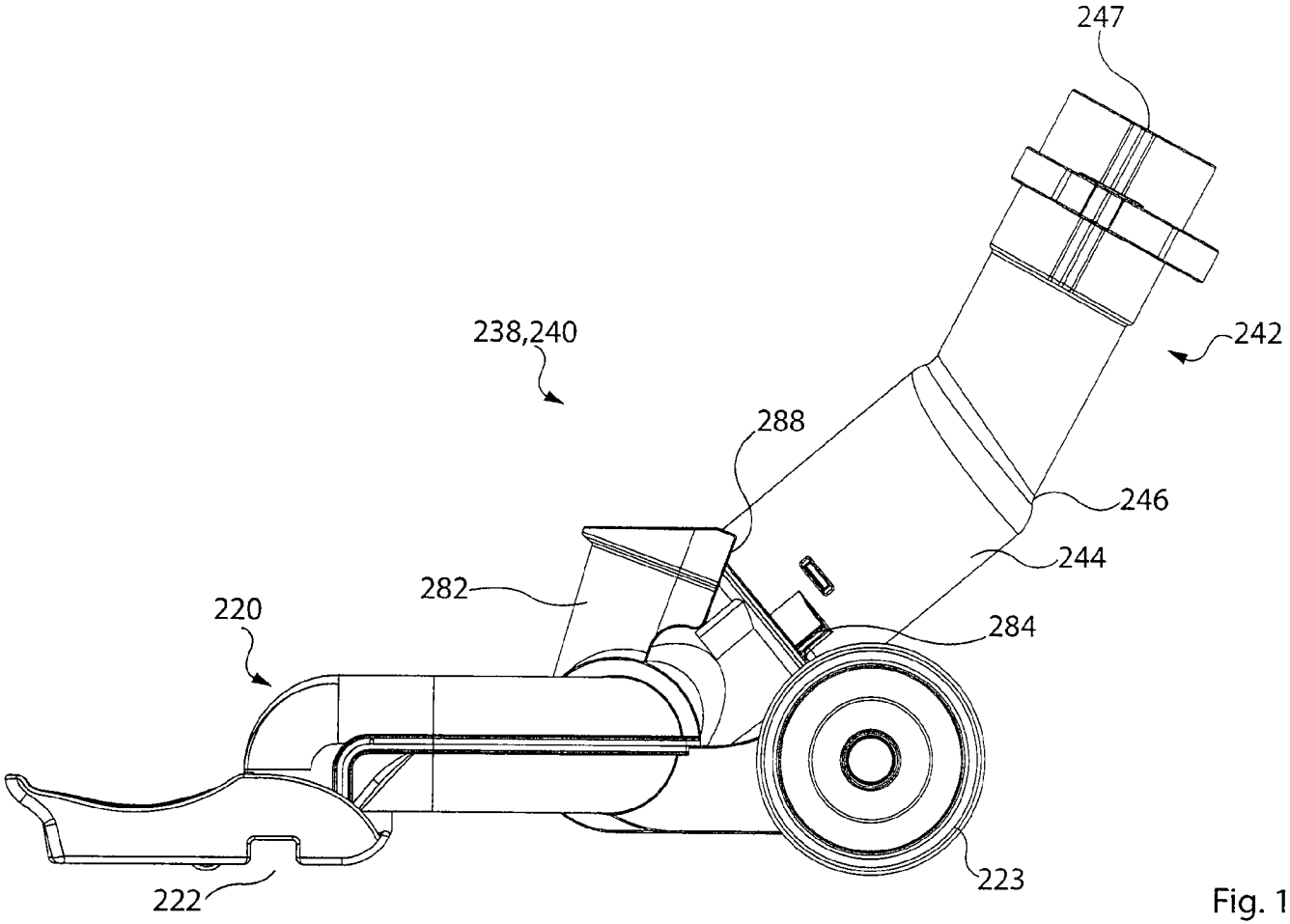
FIG. 14 is a side elevation view of the alternate embodiment of the coupling portion in the orientation of FIG. 11; and, FIG. 15 is a front isometric view of the alternate embodiment of the coupling portion of FIG. 11 in a misaligned orientation.

As exemplified in FIGS. 11-15, the coupling portion 236 comprises a rotational coupling member 242 that is rotatably mounted on a mounting member 141. The mounting member 241 is pivotally connected to the surface cleaning head 220, using any method described above, so that it pivots about a pivot axis 233 between a storage position (as shown in FIGS. 12 and 13) and a floor cleaning position (as shown in FIGS. 11 and 14). As mentioned above, in this example the pivot axis 233 is spaced apart from the axis of rotation of the wheels 223. Other features of the surface cleaning head 220 may also be different than the features of surface cleaning head 120, but surface cleaning head 220 performs the same general functions as the surface cleaning head described above, and comprises wheels 223 for rolling across a surface and a dirt inlet 222 for sucking in dirt and other debris.

As described above, the mounting member 241 is a hollow, tube-like member that forms part of the air flow passage 128 (e.g., air flows therethrough or a hose of the like that transports air passes therethrough). The rotational coupling member 242 telescopingly receives a portion of the mounting member 241 (like rotational coupling member 142) and comprises a longitudinally extending member 244, an elbow 246 and an upper end 247 that is connected to, or forms part of the upper section 110. The longitudinally extending member 244 defines a longitudinal axis 248, about which the rotational coupling member 242 rotates when in use.

As exemplified, the anti-rotation locking mechanism 240 comprises a stop member or receiving member, for example cowling 282, and a pair of engaging members, for example abutment members 284, each abutment member having a forward facing abutment surface. The cowling 282 is an upstanding portion of the surface cleaning head 220 (either integral with or attached to, e.g., fixedly mounted thereto by screws, welding an adhesive or the like) preferably having a curved inner surface 286 extending between and optionally terminating at a pair of spaced, rearward facing stop faces 288. In other examples the stop faces 288 may be connected directly to the surface cleaning head 220 and/or may be separate from the cowling 282 or a cowling may not be provided.

If a cowling is provided, then the cowling is shaped such that the abutment members 284 may be moved forwardly to contact stop faces 288. It will be appreciated that cowling need not be shaped to match the shape of coupling 136 provided it has a recess for coupling 136 to be received at least partially therein. The curvature of the inner surface 286 of the cowling 282 is preferably configured to match the shape, curvature and profile of the mounting member 241, the rotational coupling member 242 and the intersection between said elements. If the coupling between the mounting member 241 and the rotational coupling member 242 results in a smooth, continuous surface having a constant diameter then the inner surface 286 of the cowling 282 may have a complimentary, smooth surface. If, as exemplified, the coupling between the mounting member 241 and the rotational coupling member 242 creates a non-uniform or stepped curved surface, the inner surface 286 of the cowling 282 may have a complimentary curved surface having the appropriate shoulders, ridges and recesses for achieving a substantially flush or uniform fit of the at least a portion of the mounting member 241 and rotational coupling member 242 within the cowling 282 when in the storage position.

The rearward facing edges of the cowling 282 comprise the cowling stop faces 288. As exemplified, the stop faces 288 are generally planar edges or surfaces of the cowling 282 that serve as stops or barriers for engaging the abutment surfaces or other portions of the corresponding abutment members 284 of the rotational coupling member 242. In other examples, the stop faces 288 of the cowling 282 may be of any suitable, complimentary profile selected to match the profile of the abutment members 284 or the abutment surfaces thereon, including having a curved surface or providing a recess for receiving a portion of a respective abutment member.

The rotational coupling member 242 comprises a pair of abutment members 284 spaced around its periphery, preferably at the lateral sides of the vacuum cleaner 100, for engaging the cowling 282 when in the storage position. As exemplified, the two abutment members 284 are spaced on substantially opposing lateral sides of the rotational coupling member 242, separated by approximately 180°. In other examples, the spacing of the abutment members 284 may spacing of the abutment members may be greater or less than 180°, and the arc length subtended by the curved inner surface 286 of the cowling 282, may be selected to match the abutment member 284 spacing, or vice versa.

As exemplified in FIGS. 12 and 13, when the upper section of the vacuum cleaner 100 is in the storage position, the rotational coupling member 242 is at least partially received within the cowling 282 and each abutment member 284 is engaged by its respective stop face 288. In this configuration, rotation of the rotational coupling member 242 (and the upper section attached thereto) relative to the mounting member 241 is prevented by the engagement of the abutment members 284 with their respective stop faces 288.

For example, rotation of the rotational coupling member 242 in the clockwise direction (when viewed in FIG. 12) is prevented by the interference between the left (relative to the front-back orientation defined above) abutment member 284 and its corresponding stop face 288. Similarly, rotation of the rotational coupling member 242 in the counter-clockwise direction is inhibited by the interference between the right abutment member 284 and its corresponding stop face 288. This anti-rotation locking effect is created automatically when the rotational coupling member 242 is received within or seated within the cowling 282 in the storage position and is automatically disengaged or released when the rotational coupling member 242 is pivoted rearwardly into the floor cleaning position, thereby disengaging the abutment members 284 from the stop faces 288 (as shown in FIGS. 11 and 14).

The abutment members 284 may be integrally formed with the rotational coupling member 242 or may be separate elements that are attached to the rotational coupling member 242 using known means.

While the anti-rotation locking mechanisms 140, 240 inhibit rotation of the upper section 110 of the vacuum cleaner 100 when the vacuum cleaner 100 is in the storage configuration, in some examples it may also be desirable to provide a mechanism to ensure that the upper section 110 is properly aligned with the surface cleaning head 120 (i.e. the center of gravity 130 is in its desired position) before locking the upper section 110 in place.

In accordance with this aspect, which may be used by itself or with any one or more other aspects, the upper section is rotationally mounted to the surface cleaning head and is moveable between a storage position and a floor cleaning position. The storage position includes a particular orientation of the support structure relative to the surface cleaning head and the upright vacuum cleaning includes an alignment mechanism for guiding or aligning the upper section in the desired orientation.

Referring to FIGS. 4-10, a first example of an alignment mechanism 138 for guiding the upper section 110 toward a middle or center orientation or position in which the center of gravity 130 lies in the centerline plane 134 is provided. In this example, portions of the anti-rotation locking mechanism 140 also comprise elements of the alignment mechanism 138 on the vacuum cleaner 100. In other examples, the anti-rotation locking mechanism 140 and the alignment mechanism 138 may be partially or completely separate.

As exemplified, the alignment mechanism 138 comprises the driving relationship between the upward facing projections 162 on the locking ring upper face 158 and an alignment cam surface 180 formed by a portion of the flange lower face 166.

When the upper section 110 is moved toward the storage position, locking pins 154 are driven upward by cam surface 174 on the surface cleaning head 120, which drives the locking ring 150 upward and moves the projections 162 into the notches 168 as described above. However, if the upper section 110 is not orientated properly or is not "centered" (i.e. not facing directly forward so that the center of gravity 130 lies within the centerline plane 134), then the upward facing projections 162 will not be properly aligned with their respective notches 168. In the absence of an aligning mechanism, if the projections 162 are moved upward when not properly aligned with the notches 168, the projections 162 would contact and interfere with a portion of the flange lower face 166, possibly preventing the upper section 110 from fully reaching the storage position, and possibly preventing the anti-rotation locking mechanism 140 from properly engaging (i.e. the projections 162 may not enter their respective notches 168).

To help orient the upper section 110, the vacuum cleaner 100 comprises the alignment mechanism 138. As exemplified, the alignment mechanism 138 comprises a pair of alignment cam surfaces 180 located on opposing sides of each notch 168.

Each alignment cam surface 180 extends at an angle or incline, extending generally upwardly from the flange lower face 166 toward the notch 168. If the upper section 110 is not centered when it is pivoted toward the storage position, then when the locking ring 150 moves upward each upward facing projection 162 will contact a respective alignment cam surface 180. As the upper section 110 is moved, the upward force applied by the locking ring 150 will increase (as the spring compression increases) and the angled nature of the alignment cam surfaces 180 will guide or urge the projections 162 upward, along the alignment cam surface 180 toward the notches 168. Movement of the projections 162 upward, along the alignment cam surface 180 profile will cause the upper section 110 to automatically rotate toward the centered position, and will lead to the projections 162 being aligned with their respective notches 168. Once aligned with their respective notches 168, the rotational force exerted on the projections 162 by the alignment cam surfaces 180 will decrease while the upward force exerted by the springs 176 will urge, snap or click the projections 162 into their respective notches 168, automatically locking the centered upper section 110 in place.

The length, width, slope and profile of each alignment cam surface 180 may be selected based on the size and configuration of the projections 162 and notches 168. Also, while each pair of alignment cam surfaces 180 is shown as being symmetrical (about the notch 168) it is understood that in some examples, each alignment cam surface 180 may have a unique configuration. Further, only a single cam surface may be used to guide the coupling member 142 in a particular direction.

A second example of an alignment mechanism is exemplified in FIGS. 11-15. In this example, the first cooperating alignment member comprise abutment members 284 provided on opposed sides of the upper section 110 and the second cooperating alignment member comprises a stop member provided on the surface cleaning head, namely stop faces 288 In this example, abutment members 284 and stop faces 288 are also elements in the alignment mechanism 238. As exemplified, non-uniform engagement between the abutment members 284 and the stop faces 288, as the rotational coupling member 242 is pivoting toward the storage positions (as opposed to when it is already in the storage position as described above with respect to the anti-rotation locking mechanism), provides the alignment function of the alignment mechanism 238 and is used to ensure that the upper section 110 of the vacuum cleaner 100 is in the "centered" orientation (as defined above) when it reaches the storage position.

In this example, the abutment members 284 and cowling stop faces 288 are positioned symmetrically about the longitudinal axis 248, relative to the front of the vacuum cleaner. When the upper section 110 is centered and pivoting toward the storage position, the left and right abutment members 284 engage their respective stop faces 288 at the same, or substantially the same time. However, when the upper section is not centered, one abutment member 284 will engage its stop face 288 before the second abutment member 284 engages its respective stop face 288.

For example, if the upper section 110 is rotated slightly clockwise relative to its center position when it is moved toward the storage position, (when viewed in FIG. 11) the left abutment member 284 will contact the left stop face 288 before the right abutment member 284 will contact the right stop face 288. The contact between the left abutment member 284 and stop face 288 will create a reaction force acting on the left abutment member 284 which will produce an unbalanced rotational force (or torque) on the rotational coupling member 242. This torque will lead to rotation of the rotational coupling member 242 (and the upper section attached thereto) in the counter-clockwise direction until a matching or balancing reaction force or torque is generated on the right side of the rotational coupling member 242. In this example, a suitable balancing reaction force or torque will be created when the upper section 110 is pivoted to a position that causes engagement between the right abutment member 284 and the right stop face 288. As the upper section is pivoted toward the storage position, the magnitude of the unbalanced reaction force may increase causing an automatic rotation or alignment of the rotational coupling member 242.

In some examples, the rotational force exerted on the left abutment member 284 may lead to an over-rotation of the upper section 110 (i.e. past the center position), leading to an upper section 110 that is misaligned and rotated slightly in the counter-clockwise direction, for example. In such examples, as the upper section 110 continues to be pivoted forward by the user, the right abutment member 284 will be positioned forward of the left abutment member 284 and will contact the right stop face 288 before the left abutment member 284 engages the left stop face 288. An unbalanced rotational force will then be created in the clockwise direction, moving the rotational coupling member 242 toward the centered position. Alternating contact between the left and right abutment members 284 can iteratively drive the rotational coupling member 242 toward the desired, aligned orientation.

When the upper section 110 is properly oriented, the magnitude of the forces exerted on the left and right abutment members 284 will be substantially equal which will keep the upper section 110 in the centered position. When the upper section 110 is fully pivoted into the storage position, rotation of the upper section 110 relative to the surface cleaning head 120 is inhibited by the anti-rotation locking mechanism 140.

Figure 15:
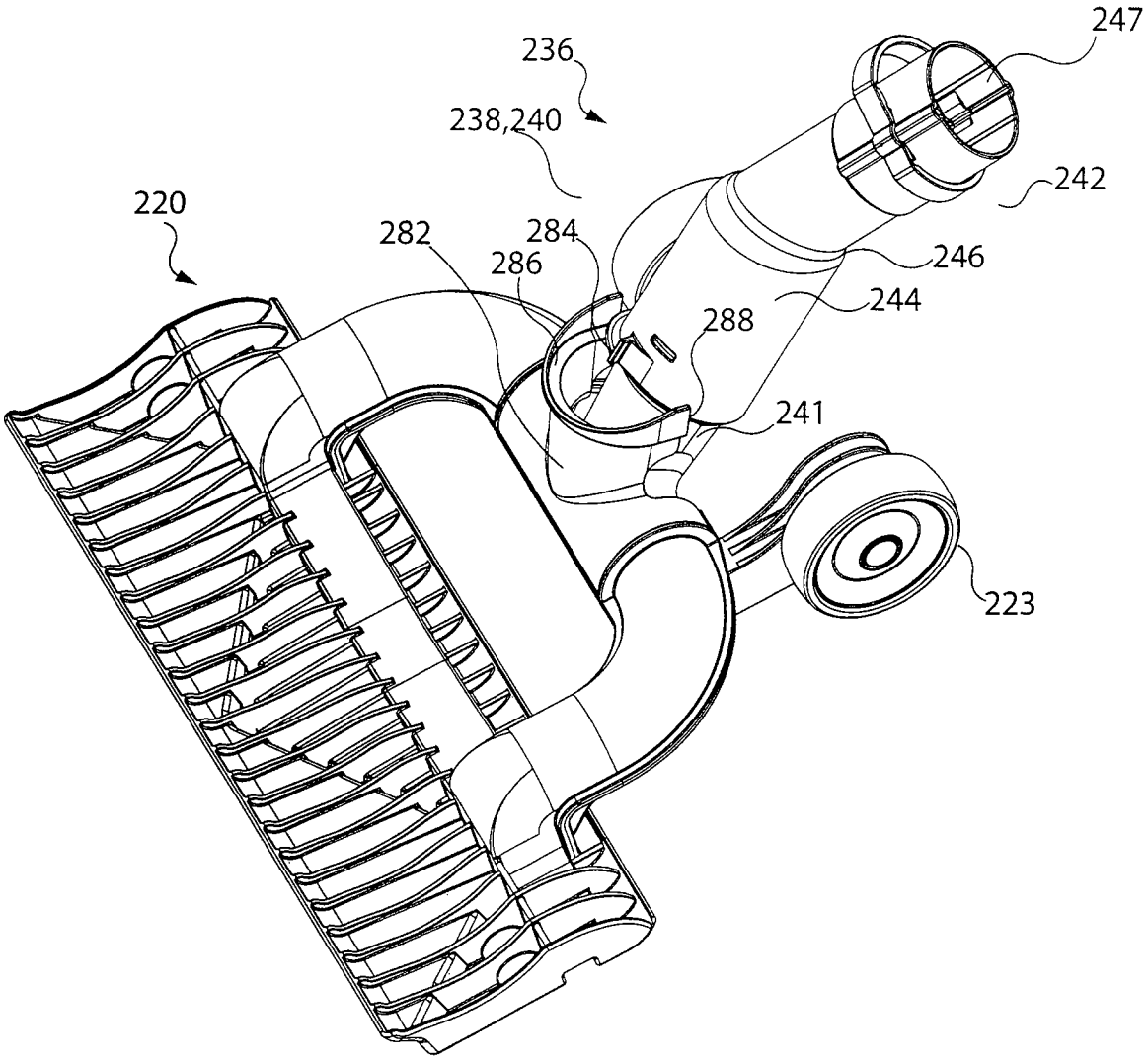

In some examples, as exemplified in FIG. 15, the rotational coupling member 242 may be rotated in the counter-clockwise direction to such an extent that the right abutment member 284 is rotated to a position in which it will not engage the right stop face 288 when the upper section is pivoted forward. Accordingly, the abutment member 284 will contact the curved inner surface 286 of the cowling 282. This interference between the abutment member 284 and the inner surface 286 of the cowling 282 may prevent the rotational coupling member 242 from being properly or adequately received within the cowling 282 and may prevent the upper section 110 from reaching the storage position. In response to the interference described above, the user may pivot the upper section rearward and manually rotate the upper section to a position that is closer to the centered position and in which the abutment members 284 can engage their respective stop faces 288. Having rotated the upper section to an appropriate position, the user may then pivot the upper section forward and utilized the auto-aligning and auto-locking features of the alignment mechanism 238 and anti-rotation locking mechanism 240. Accordingly, this interference will warn a user that the upper section is not correctly aligned.

Preferably, the alignment mechanism may be configured to correct the alignment if the upper section is out of alignment by 10°, preferably by 15°, more preferably by 25° and most preferably by 40°.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

The invention claimed is:

1. An upright surface cleaning apparatus having a front, a rear and opposed lateral sides and comprising:

a) a surface cleaning head having a dirt inlet;

b) an upper section moveably mounted to the surface cleaning head between a floor cleaning position, in which the upright surface cleaning apparatus is useable for cleaning a floor, and a storage position in which the upper section is maintained in an upright position relative to the floor, the upper section having a longitudinal axis extending between an upper end and a lower end of the upper section, the upper section also being rotatably coupled to the surface cleaning head whereby rotation of the upper section relative to the surface cleaning head is enabled;

c) a cleaning unit removably mounted to the upper section, the cleaning unit comprising an air treatment member, a suction motor and a clean air outlet and wherein the cleaning unit is usable in both a mounted and an unmounted configuration;

d) an air flow path extending from the dirt inlet to the clean air outlet and comprising the air treatment member and the suction motor;

e) an anti-rotation locking mechanism inhibiting rotation of the upper section when the upper section is in the storage position;

wherein the cleaning unit is removable while the upper section is in the storage position, and wherein the upper section is rotatable relative to the surface cleaning head about the longitudinal axis when the cleaning unit is mounted to the upper section and the upper section is in the floor cleaning position.

2. The upright surface cleaning apparatus of claim 1, wherein the surface cleaning apparatus has at least two operating modes comprising: a first operating mode in which the cleaning unit is mounted to the upper section and is in airflow communication with the dirt inlet and a flexible hose comprises a portion of the airflow path between the cleaning unit and the dirt inlet; and a second operating mode in which the cleaning unit is removed from the upper section and is in airflow communication with the dirt inlet and the flexible hose comprises a portion of the airflow path between the cleaning unit and the dirt inlet.

3. The upright surface cleaning apparatus of claim 2, wherein when the surface cleaning apparatus is in the first operating mode the cleaning unit is supported by the upper section.

4. The upright surface cleaning apparatus of claim 2, wherein the upper section is movable between the storage position and the floor cleaning position when the surface cleaning apparatus is in the first operating mode and when the surface cleaning apparatus is in the second operating mode.

5. The upright surface cleaning apparatus of claim 2, wherein the surface cleaning apparatus is changeable between the first operating mode and the second operating mode without interrupting the airflow communication between the dirt inlet and the cleaning unit.

6. The upright surface cleaning apparatus of claim 2, wherein the surface cleaning apparatus is operable in a third operating mode in which the cleaning unit is detached from the upper section and is not in air flow communication with the surface cleaning head and is operable as a hand vacuum cleaner.

7. The upright surface cleaning apparatus of claim 1, wherein the upper section comprises a rigid airflow conduit, and wherein the cleaning unit is supported on the rigid airflow conduit when mounted to the upper section.

8. The upright surface cleaning apparatus of claim 1, wherein the cleaning unit is vertically removable from the upper section when the upper section is in the storage position.

9. The upright surface cleaning apparatus of claim 1, wherein the cleaning unit is removable in the absence of adjusting a configuration of the upper section.

10. The upright surface cleaning apparatus of claim 1, wherein the anti-rotation locking mechanism comprises a first abutment member and a second abutment member spaced apart from the first abutment member provided on a portion of the upper section that is rotatable about the longitudinal axis, the first and second abutment members each extending laterally outward from one of the surface cleaning head and the upper section, the other of the surface cleaning head and the upper section comprising a stop member having a first stop face and a second stop face spaced apart from the first stop face, when the upper section is in the storage position the first abutment member abuts the first stop face and the second abutment member abuts the second stop face whereby rotation of the upper section about the longitudinal axis is inhibited, and when the upper section is in the floor cleaning position the first abutment member is spaced apart from the first stop face and the second abutment member is spaced apart from the second stop face.

11. The upright surface cleaning apparatus of claim 10, wherein the first and second abutment members and the stop member comprise an alignment mechanism whereby contact between at least one of the abutment members and the stop member guides the upper section to a storage rotational orientation when the upper section is moved from the floor cleaning position into the storage position.

12. The upright surface cleaning apparatus of claim 1, wherein the upper section is rotatably coupled to the surface cleaning head by a rotational coupling member and the rotational coupling member comprises a portion of the air flow path.

13. The upright surface cleaning apparatus of claim 10, wherein the first and second abutment members are provided on opposed sides of the upper section and the stop member is provided on the surface cleaning head.

14. The upright surface cleaning apparatus of claim 1, wherein the upper section comprises a rotational coupling member having a longitudinally extending member that comprises a portion of the airflow path and extends along a longitudinal axis, whereby the longitudinal axis extends through a portion of the airflow path.

15. The upright surface cleaning apparatus of claim 1, wherein the air flow path comprising a flexible hose having a downstream end coupled to the cleaning unit.

16. The upright surface cleaning apparatus of claim 2, wherein the anti-rotation locking mechanism is operable in both the first and second operating modes.

17. The upright surface cleaning apparatus of claim 1, wherein the air treatment member comprises at least a first cyclone chamber having an air inlet, an air outlet and a dirt outlet, and at least a first dirt collection chamber in communication with the dirt outlet.

18. The upright surface cleaning apparatus of claim 17, wherein the first dirt collection chamber is external the first cyclone chamber.

19. The upright surface cleaning apparatus of claim 17, wherein the first cyclone chamber comprises a cyclone axis about which air within the first cyclone circulates and the first dirt collection chamber is disposed at least partially axially between the first cyclone chamber and the suction motor.

* * * * *